US009522564B2

(12) United States Patent
Slevin et al.

(10) Patent No.: US 9,522,564 B2
(45) Date of Patent: Dec. 20, 2016

(54) ADHESIVE APPLICATOR

(71) Applicant: DISRUPTIVE ADHESIVES LIMITED, Leeds (GB)

(72) Inventors: Peter Slevin, Holmfirth (GB); Adam Robinson, Leeds (GB)

(73) Assignee: Disruptive Adhesives Limited, Leeds (GB)

( * ) Notice: Subject to any disclaimer, the term of this patent is extended or adjusted under 35 U.S.C. 154(b) by 125 days.

(21) Appl. No.: 14/390,525

(22) PCT Filed: Apr. 2, 2013

(86) PCT No.: PCT/GB2013/050859

§ 371 (c)(1),
(2) Date: Oct. 3, 2014

(87) PCT Pub. No.: WO2013/150287

PCT Pub. Date: Oct. 10, 2013

(65) Prior Publication Data

US 2015/0191041 A1 Jul. 9, 2015

(30) Foreign Application Priority Data

Apr. 3, 2012 (GB) ..... 1205977.0
Apr. 3, 2012 (GB) ..... 1205982.0

(51) Int. Cl.
*B43M 11/06* (2006.01)
*A45D 40/00* (2006.01)
(Continued)

(52) U.S. Cl.
CPC ..... *B43M 11/06* (2013.01); *A45D 40/00* (2013.01); *B05C 13/02* (2013.01); *B05C 17/0052* (2013.01); *A45D 2040/0006* (2013.01)

(58) Field of Classification Search
CPC A45D 40/04; A45D 40/06; A45D 2040/0006; A45D 2200/05; B05C 1/006; B05C 1/027; B05C 13/02; B05C 17/0052; B43M 11/00; B43M 11/06; B65D 43/12; C09J 9/005
(Continued)

(56) References Cited

U.S. PATENT DOCUMENTS 807,887 A 12/1905 Walker
4,580,920 A * 4/1986 Schmidt ..... A45D 40/04 401/75
(Continued)

FOREIGN PATENT DOCUMENTS

DE 4309352 A1 9/1994
GB 2500898 A 10/2013
(Continued)

OTHER PUBLICATIONS

"Adhesive Applicator", United Kingdom Application Serial No. 1205977.0, filed on Apr. 3, 2012, 47 pgs.
(Continued)

*Primary Examiner* — Jennifer C Chiang
*Assistant Examiner* — Bradley Oliver
(74) *Attorney, Agent, or Firm* — Kwan & Olynick LLP

(57) ABSTRACT

An adhesive applicator comprising: (iv) an elongate tubular body having a first open end and an opposed, second end, (v) a rod of adhesive material located within the tubular body, said rod being axially moveable along the body so that a free end of the rod is able to travel relatively past the first end of the body, and for said rod being retainable at a selected axial position, and (vi) an applicator head mounted on the first end of the body, wherein the head is axially moveable relative to the body and has a mouth configured as a transverse slot into which the edge of a sheet material may be inserted, said mouth having a roof surface between which and the free end of the rod the edge of the paper may be held, and the head
(Continued)

has a pressure applicator to which pressure may be applied to effect movement of the head relatively towards the second end of the body; wherein the applicator head is completely removable from the body; and wherein the applicator head is configured to act as a closure for the first end of the applicator body.

20 Claims, 27 Drawing Sheets

(51) Int. Cl.
*B05C 13/02* (2006.01)
*B05C 17/005* (2006.01)

(58) Field of Classification Search
USPC ..... 401/1–2, 10, 48, 193
See application file for complete search history.

(56) References Cited

U.S. PATENT DOCUMENTS 5,078,527 A 1/1992 Bell
5,605,572 A 2/1997 Berger
2011/0243640 A1* 10/2011 Bogert ..... B43K 23/001 401/193

FOREIGN PATENT DOCUMENTS

JP 2009179331 A 8/2009
KR 20060106947 A 10/2006
WO 2013150287 A2 10/2013

OTHER PUBLICATIONS

"International Application Serial No. PCT/GB2013/050859, Search Report mailed Aug. 1, 2014", 3 pgs.

"United Kingdom Application Serial No. 1205982.0, Search Report dated Jan. 24, 2013", 2 pgs.

* cited by examiner

ADHESIVE APPLICATOR

CROSS-REFERENCE TO RELATED APPLICATIONS

This application is a U.S. national application under U.S.C. 371 of PCT Application Number PCT/GB2013/050859, entitled ADHESIVE APPLICATOR, filed 2 Apr. 2013 by Peter Slevin et al., which claims priority under 35 U.S.C. 119(b) of GB Patent Application Number 1205982.0, filed 3 Apr. 2012, titled "ADHESIVE APPLICATOR", and GB Patent Application Number 1205977.0, filed 2 Apr. 2012, titled "ADHESIVE APPLICATOR". Each application is herein incorporated by reference in its entirety for all purposes.

The present invention relates to adhesive applicators of the type frequently referred to as "glue sticks". The invention relates more particularly to new constructions of such applicators and also to adaptor units for converting existing applicators to the new construction.

Adhesive applicators as the type known as "glue sticks" comprise a rod (usually cylindrical) of adhesive material located within a tubular body (which may be of circular or other cross-section). One end of the body is fitted with a removable cap. The applicator further comprises a mechanism for axial movement of the rod along the body and retaining the rod at a selected position. Thus, in use of the applicator, the cap is removed and the rod is advanced by the mechanism so as to project from the now open end of the body. The tip of the rod may then be run along a substrate (e.g. a sheet of paper) to which adhesive is to be applied. For the application of the adhesive thereto, the sheet is generally (but not necessarily) laid flat on a rigid surface and the adhesive is applied as desired to the sheet. There is however a "difficulty" when the applicator is used for the application of a line of adhesive at a marginal edge region of the sheet. Consider that the sheet is on a flat surface. Application of the adhesive to the edge region may also cause adhesive to be applied beyond the edge onto the surface below. Problems associated with application of adhesive to the surface can, of course, be avoided by positioning a further sheet of paper on the surface beneath, and projecting beyond, the edge of the sheet to which adhesive is to be applied. Any adhesive applied beyond the edge is then also applied to an underlying sheet. However this can be regarded as a waste of both glue and a (the underlying) sheet of paper. Obviously if the underlying paper is not present then the surface becomes messy. An alternative is to apply the adhesive a little inwardly of the edge. This avoids adhesive being applied beyond the edge but may leave a region of the edge to which no adhesive is applied.

It is an objective of the present invention to obviate or mitigate the abovementioned disadvantages.

According to a first aspect of the present invention there is provided an adhesive applicator comprising:

(i) an elongate tubular body having a first open end and an opposed, second end (which may be closed), (ii) a rod of adhesive material located within the tubular body, said rod being axially movable along the body so that a free end of the rod is able to travel relatively past the first end of the body, and said rod being retainable at a selected axial position, and (iii) an applicator head mounted on the first end of the body, wherein the head is axially moveable relative to the body and has a mouth configured as a transverse slot into which the edge of a sheet material may be inserted, said mouth having a roof surface between which and the free end of the rod the edge of the paper may be held, and the head has a pressure applicator to which pressure may be applied to effect movement of the head relatively towards the second end of the body; wherein the applicator head is completely removable from the body; and wherein the applicator head is configured to act as a closure for the first end of the applicator body.

The adhesive applicator of the invention considerably facilitates application of adhesive to the edge of a sheet of paper (or other substrate). To use the applicator, the adhesive rod is advanced to the lower lip of the mouth of the applicator head. The edge of the sheet is then inserted into the mouth and pressure applied (to the pressure applicator member) to move the head and the sheet edge together against the end of the adhesive rod. With pressure continuing to be applied to the pressure applicator member, the edge of the sheet is drawn relatively through the mouth of the applicator head. As the adhesive is applied to the paper, the free end of the rod does "wear down" to a degree due to the dispensation of adhesive onto the sheet. However the continued application of pressure to the head ensures that the latter moves axially towards the second end of the body so that the edge of the paper (or other substrate) continues to be contacted by both the surface of the mouth and the free end of the rod to ensure that the paper continues to be in contact with the free end of the rod, even as the latter wears down. During movement of the paper relatively through the mouth, its edge is guided by the formation of the mouth so that a straight line of adhesive is applied along the substrate edge.

It will be appreciated that other features of the adhesive applicator may be conventional. Thus, for example, axial movement of the rod of adhesive material within the tubular body may be provided by a screw mechanism located at the second end of the body.

The applicator head is completely removable from the body. The applicator of the invention has flexibility in that the head may be removed and the applicator used in a conventional manner to apply adhesive to any region of a substrate sheet. Additionally, the applicator head is configured to act as a closure for the adhesive applicator when not in use.

The mouth may be configured to allow insertion of the sheet edge to a desired degree. This may, for example, be to ensure that the full cross-section of the free end of the adhesive rod may be applied to the marginal edge region of the sheet. Alternatively, the mouth may be configured so that the majority (but not all) of the surface at the free end of the rod is applied to the edge region. It is also within the ambit of the invention for the mouth to be configured so that only a minority of the surface area of the free end of the adhesive rod is applied to the edge region, e.g. in the case where a very narrow glue line is to be applied. The mouth is preferably configured to have rear, axially extending edges positioned to determine the extent to which the sheet may be inserted in the mouth and therefore determine the proportion of the area of the free end of the adhesive rod that is able to apply adhesive to the edge.

The applicator of the first aspect of the invention adaptor may be such that, for the purposes of application of adhesive to the marginal edge region of a sheet, the head is axially moveable between first and second limit positions with the second position being relatively towards the second end of the body as compared to the first position. The head may be releasably held at these positions so as to allow the head to be moved (in one direction) past the first limit position to allow removal of the head from the body and to be moved in the other direction past the second limit position to close the body. These limit positions have the advantage of effecting a secure closure of the tube when the head applicator is moved past the second limit position (preventing the glue rod drying out between uses) and ensures the head applicator remains in stable contact with the tube body at the start point of application (remains within the zone that has the first and second limit positions as its boundaries). The axial movement of the head relative to the body may be effected by linear movement of the head relative to the body. Alternatively, for the case where the body is cylindrical, the head may be rotatably mounted on the body with there being provision for conversion of this rotary movement to axial movement of the head. Various specific constructions operating in accordance with these two possibilities are shown in the accompanying drawings and defined in the appended claims.

The pressure applicator member may be one configured for the application of finger or thumb pressure thereto to ensure movement of the head relative to the body during application of adhesive. Alternatively, the pressure applicator member may be pressed against, and moved along, a rigid surface (e.g. a desktop) to apply the requisite pressure. For this purpose, the pressure applicator member may have an additional "formation" which is used to contact the surface and facilitate movement of the applicator along the surface (as well as assisting or enhancing the application of pressure). This additional "formation" may for example be a fixed projection (e.g. in the form of a nipple) on the pressure applicator member. Alternatively, the "formation" may be a ball mounted on the top of the pressure applicator member for rotation in all directions (i.e. in the form of a "roller-ball"). A further possibility is that this "formation" comprises a wheel.

Adhesive applicators as defined (and described above) for the first aspect of the invention may be constructed as such. The invention does however further provide an adaptor head that may be fitted to the body of a conventional adhesive applicator to convert it to one in accordance with the first aspect of the invention. In this respect, a second aspect of the invention provides an adaptor unit for an adhesive applicator of the type comprising;

(i) an elongate tubular body having a first open end and an opposed, second end, and (ii) a rod of adhesive material located within the tubular body, said rod being moveable along the body so that a free end of the rod is able to travel relatively past the first end of the body, and said rod being retainable at a selected axial position, and wherein the adaptor unit comprises:

(a) an adaptor body for mounting on the applicator body, (b) an adaptor head associated with the adaptor body in such a way that when the latter is mounted on the applicatory body the adaptor head is axially moveable relative thereto, (c) a pressure applicator member to which pressure may be applied to effect movement of the adaptor head relatively towards the second end of the applicator body, and (d) a mouth in the adaptor head configured as a transverse slot into which the edge of a sheet of material may be inserted, said mouth having a roof surface between which and the free end of the rod the edge of the paper may be held.

In one embodiment of the adaptor unit, the adaptor head is fixed relative to the adaptor body. For this embodiment, the adaptor body may comprise a pair of arms providing a clip for removably locating the adaptor unit on the applicator body. These arms have upper edges defining lower edges of the transverse slot. Furthermore in this embodiment the pressure applicator may include a disk member having an undersurface providing the roof surface of the mouth. As a modification of this embodiment, the adapter body may be tubular for location over the first end of the applicator.

In a further embodiment of adaptor unit the adaptor head is moveable relative to the adaptor body. For this embodiment, the adaptor body may be tubular and have first and second ends, the latter of which is configured for mounting over the first end of the adhesive applicator.

All features of the invention described above in relation to the first aspect of the invention are applicable mutatis mutandis to the second aspect.

The invention will be further described, by way of example only, with reference to the accompanying drawings, in which.

Figure 1:
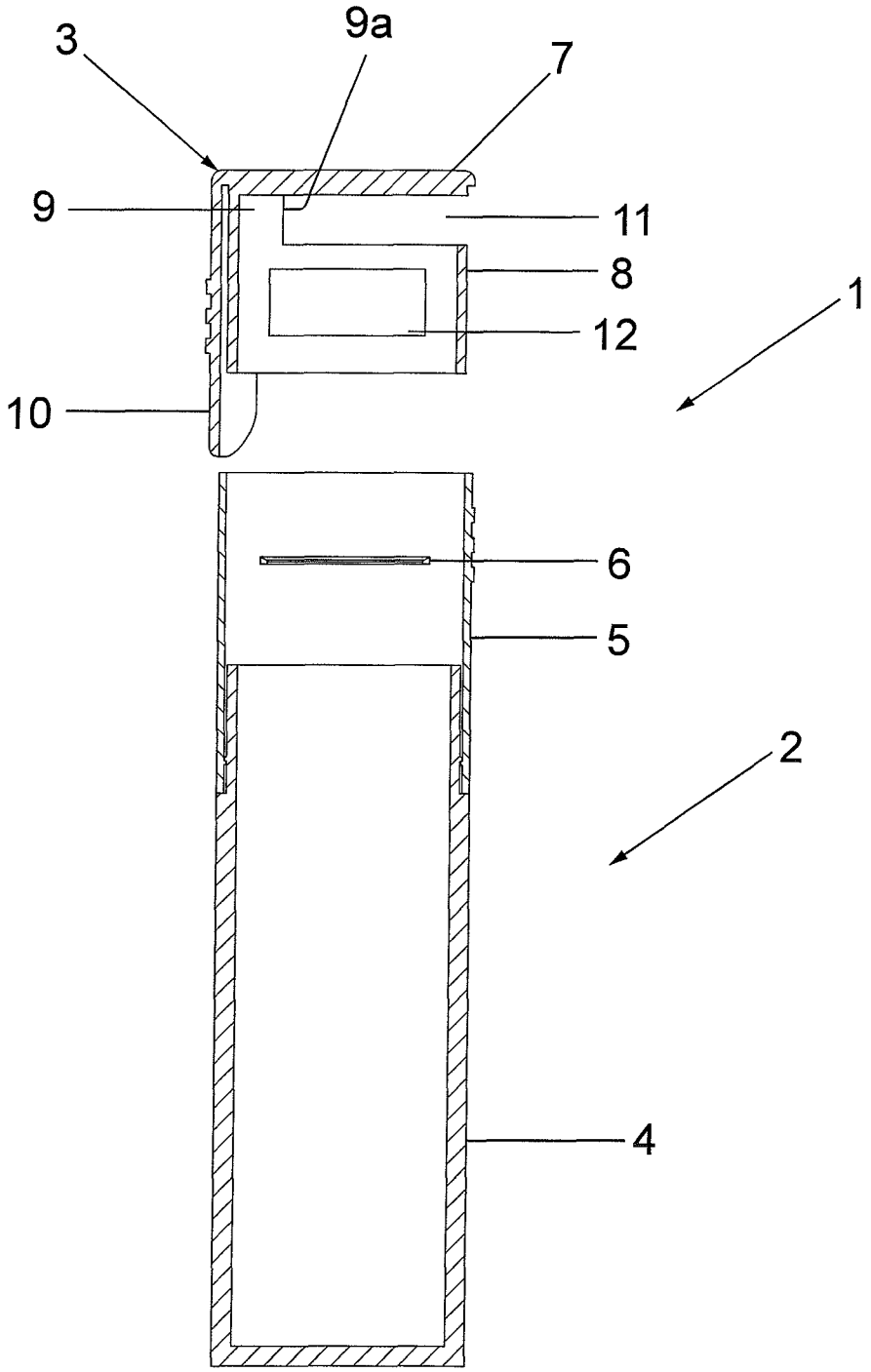
FIG. 1 is an exploded, sectional view of a first embodiment of glue applicator in accordance with the invention shown with the head of the applicator separated from the body thereof.

As shown in FIG. 1, a glue applicator 1 in accordance with the invention comprises an elongate cylindrical body 2 and a removable head 3 (shown in FIG. 1 as being removed from the body 2). Head 3 is the component part of the adhesive applicator 1 that facilitates application of a line of adhesive along an edge of a sheet of paper or other substrate to which adhesive is to be applied. Cylindrical body 2 is illustrated as being in two parts, namely a lower casing 4 and an upper adaptor tube 5 located at its lower end in a peripheral recess of the casing 4. Within cylindrical body 2 is a glue rod (omitted from the drawings for the purposes of clarity). This glue rod may be of conventional composition as used in commercially available adhesive applicators of the type known as "glue sticks". This glue rod may be advanced and retracted along the body 2 by means of a screw mechanism (again omitted from the drawings for the purpose of clarity) of the type used for this purpose in commercially available glue applicators.

The inner surface of body 2 is generally smooth but the internal surface of adaptor tube 5 is provided with a rib 6 extending part way around the inner peripheral surface of adaptor tube 5 and located just above the mid-point of the distance between the upper ends of casing 4 and adaptor tube 5. The function of the rib 6 will be described more fully below.

A cylindrical body 2 has been shown as being formed of the cylindrical casing 4 and separate adaptor tube 5 since the former (i.e. the casing 4) may be a casing of the conventional adhesive applicator, to which the adaptor body 5 which forms part of the arrangement of the invention has been fitted. It is however within the scope of the invention for the cylindrical body 2 to be moulded in one piece and thus to include the rib 6.

In the assembled applicator, the head 3 is mounted on the adaptor tube 5 in the manner described more fully below. This combination of head 3 and tube 5 forms a removable closure assembly for the applicator in that this assembly may be removed from, and replaced on, the casing 4 as and when required. For this reason, casing 4 may be of a construction (and dimension) as used in conventional adhesive applicators, thus allowing the applicator 1 of the invention to be constructed from a conventional casing 4 by the fitting of the combination of head 3 and adaptor tube 5.

Head 3 is a one-piece plastics moulded component formed in three principal parts, namely an upper, disc-like cap 7 with a flat undersurface, a tubular guide body 8 connected to the undersurface of the cap 7 by an arcuate strut 9 which is a "part-extension" of the cylindrical wall of body 8, and a thumb (or finger) grip element 10 located radially outwardly of strut 9 and guide body 8. Tubular guide body 8 and thumb/finger grip element 10 are dimensioned such that the body 8 locates internally of adaptor tube 5 and the thumb/finger grip element 10 externally thereof.

As will be appreciated from FIG. 1, a mouth 11 (in the form of an elongate slit) is formed between the under surface of cap 7 and the upper edge of tubular guide body 8. The roof of the mouth 11 is provided by the flat undersurface of cap 7, the lower portion of the mouth 11 is provided by flat upper edges of the tubular body 8, and the rear of the mouth is provided by vertical (as seen in FIG. 1) guide edges 9*a* on the strut 9. As will be appreciated from the fuller description given below, the mouth 11 is for the purpose of accommodating an edge of a sheet of paper (or other substrate) to which adhesive is to be applied and is configured so that the majority of the cross section of the free end of the glue rod may be applied to the paper (or other substrate). To this end, strut 9 extends only a relatively short distance around the circumference of the tubular body 8 to permit insertion of the edge of a sheet of paper into the mouth 11 sufficiently far so that the majority of the cross-section of the glue rod can contact the edge of the paper.

Formed in tubular body 8 are two diametrically opposed arcuate windows 12, each having an arcuate length equal to that of rib 6 and an axial dimension somewhat greater than the axial thickness of rib 6.

In the assembled applicator, head 3 is mounted on the adaptor tube 5 by virtue of the tubular body 8 of the former locating internally of the latter (the thumb/finger grip element 10 being external of the tube 5).

Figure 2:
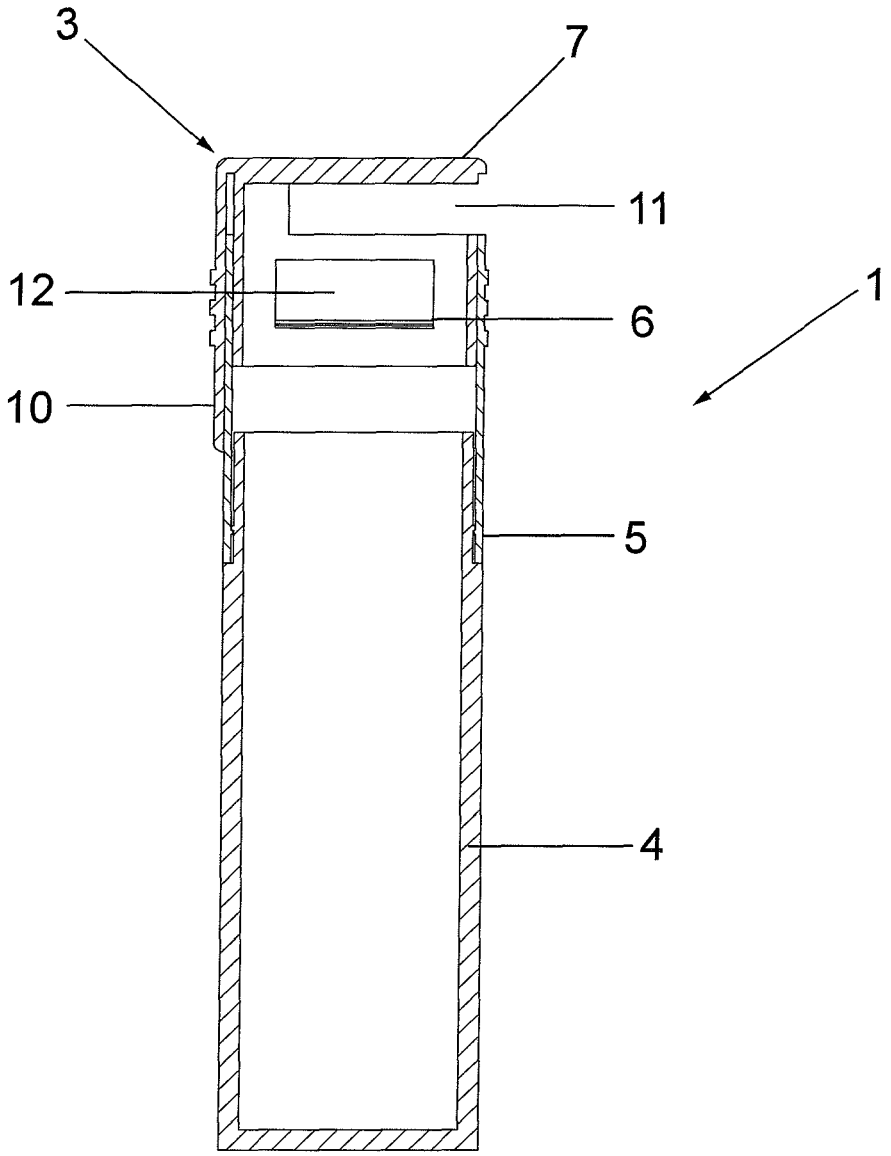
FIG. 2 is a sectional view of the applicator illustrated in FIG. 1 showing the head assembled on the body and in an "open" position for gluing an edge of a paper sheet.

Moreover, the head 3 is located in the adaptor tube 5 by pushing the lower edge of tubular body 8 past the ribs 6 to allow the latter to locate one in each of the windows 12. With the head 3 and tubular guide 8 mounted together in this way, the head may be moved between a lower position in which mouth 11 is within the adaptor tube 5 (FIG. 3) and an upper position in which the mouth 11 is above adaptor tube 5 (FIG. 2).

Figure 4:
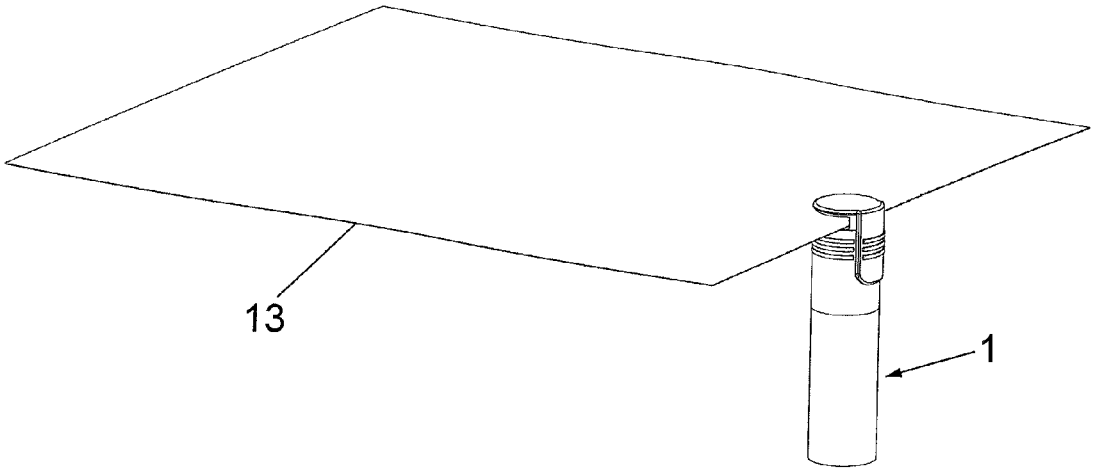
FIG. 4 shows the assembled applicator of FIG. 1 in use in gluing an edge of a paper sheet.

Reference is now made to FIG. 4 which shows use of the applicator 1 in applying adhesive to a marginal edge region of a sheet of paper (or other flat substrate), referenced as 13. In order to apply glue to the edge of a sheet of paper (or other substrate) the head 3 is moved upwardly to the position shown in FIG. 2. The adhesive rod is now advanced to the upper edges of the tubular body 8. The edge of the paper (or other substrate) is then inserted fully into mouth 11 until the paper reaches edges 9*a*. Subsequently, finger pressure is applied to the cap 7 to move the head 3 and sheet edge together against the free end of the adhesive rod. The applicator 1 is then run relatively along the edge of the paper (as shown in FIG. 4), the edge of the paper being guided by the vertical edges 9*a* of strut 9. As the glue is applied, the free-end of the glue rod "wears-away" (i.e. due to the transfer of glue for the rod to the paper). By the continued application of finger pressure to the cap 7, the head 3 is able to move downwardly into the tubular guide body 5 (this move being allowed by the relative movement of the ribs 6 in the axial direction of the windows 12). As a result, the edge of the paper remains in continuous contact with the glue rod and a coating of adhesive is applied to the edge, this coating being uniform in both thickness and width (due to guiding of the paper by the edges 9*a*).

Application of the adhesive is terminated when the sheet is withdrawn from the applicator.

Figure 3:
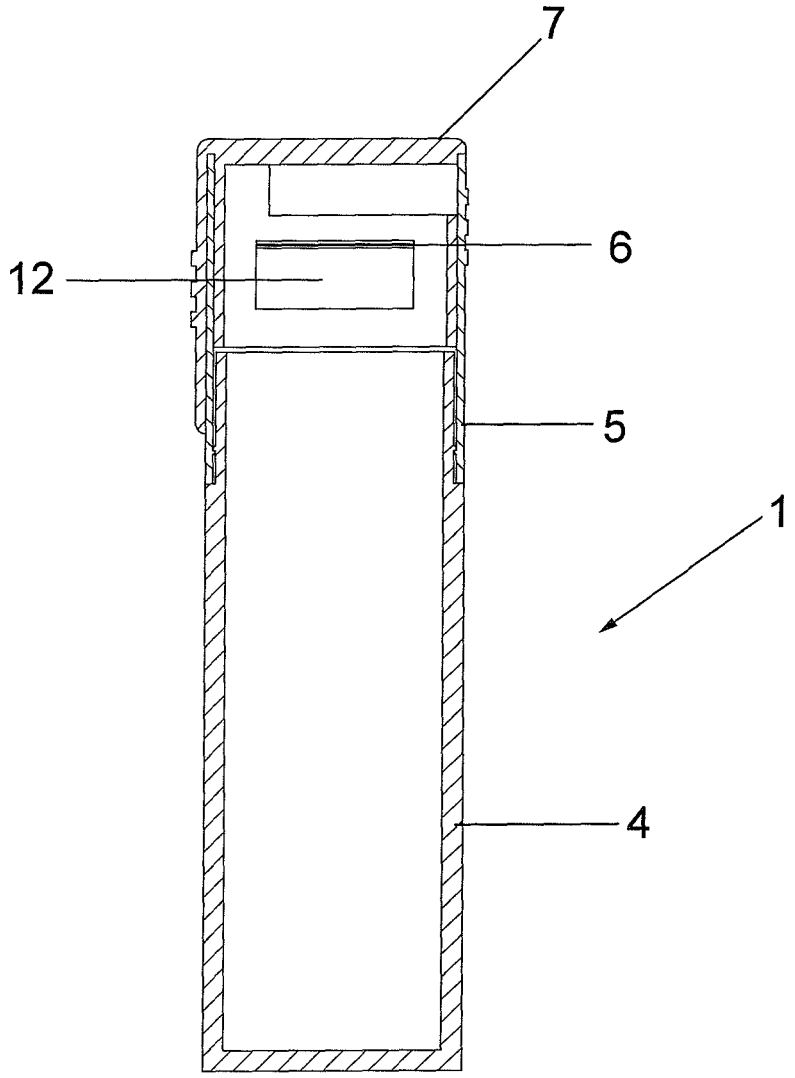
FIG. 3 is a sectional view showing the applicator of FIG. 1 in an assembled configuration with the head in a "closed" position.

When it is desired to close the applicator, the head 3 may be moved fully downwards to the position shown in FIG. 3, it being noted that the undersurface of cap 7 is configured to be located within the top of adaptor tube 5.

If it is desired to use the applicator 1 to apply adhesive to a region of paper other than the edge then the cap 3 may be removed by the reverse of the procedure described above so that adhesive may be applied as required.

Figure 5:
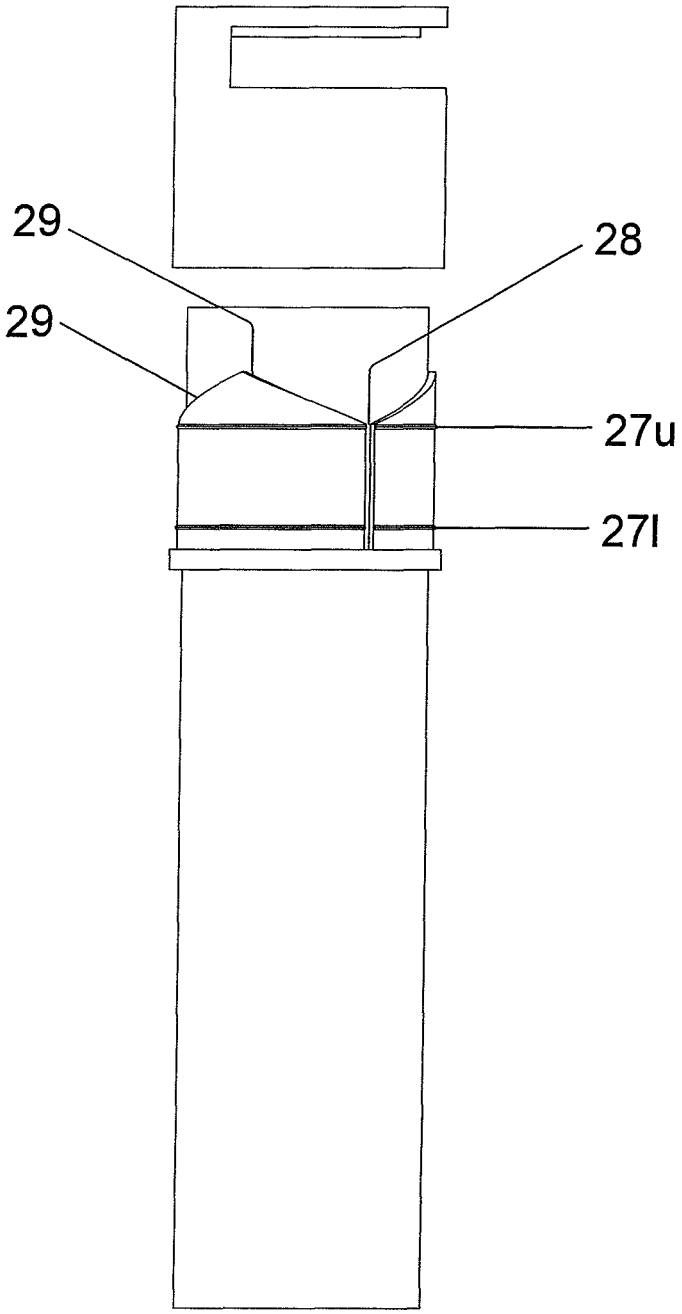
FIG. 5 is an exploded view of a second embodiment of adhesive applicator in accordance with the invention.
Figure 6:
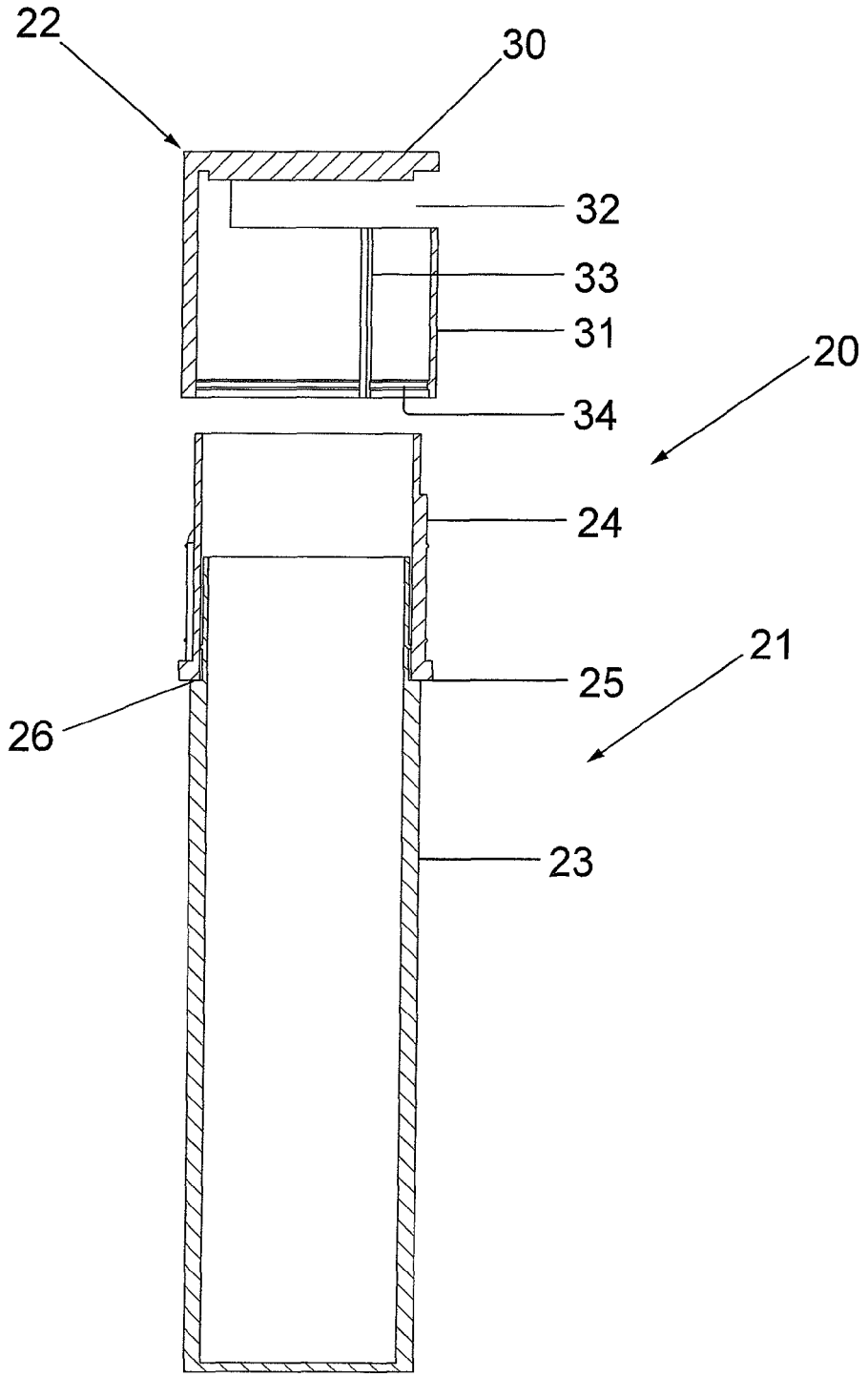
FIG. 6 is a sectional view of the applicator shown in FIG. 5.

Reference is now made to FIGS. 5 and 6 which illustrate a second embodiment of adhesive applicator 20 in accordance with the invention. This applicator comprises an elongate cylindrical body 21 and a one-piece head 22. Body 21 is shown as being constructed of a lower casing 23 and a tubular adaptor body 24, although it should be appreciated that body 21 may be moulded as a one-piece component. As in the case of the first embodiment, details of the glue rod and screw mechanism have been omitted. Adaptor body 24 is for removable location on the upper portion of body 21 (more specifically casing 23), in the manner which will be clear from FIG. 6. As seen in that figure, lower edge 25 of adaptor body 24 sits on a shoulder 26 of lower casing 23.

Provided around the adaptor 24 are two sets of axially spaced ribs 27, the lowermost set 27*l* of which is spaced above shoulder 26. Also formed on the adaptor 24 are four circumferentially spaced, axially parallel grooves 28 extending from below lower ribs 27*l* to upper ribs 27*u*. Ribs 27*l* and 27*u* are interrupted at the region of the grooves 28. Further provided on the adaptor 24 are guide edges 29 projecting transversely from the adaptor and each running from a position above upper rib 27*u* and midway between two grooves 28 down to an adjacent groove 28. Thus in effect the guide edges 29 define at least one peak between a pair of adjacent grooves, and three peaks as shown in FIG. 5, one between each pair of adjacent grooves 28.

Head 22 comprises a cap 30 and a tubular guide body 31, between which is defined a mouth 32 of similar configuration of mouth 11 of the embodiment of FIGS. 1-4. Inner surface of guide body 31 is formed with at least one axially extending rib 33 having a transverse width allowing said at least one rib to slide along any one of the axial grooves 28 in the adaptor 24. An additional circumferential rib 34 is also provided on the inner surface of guide body 31, at the lower end thereof.

To assemble the applicator 20, head 22 is positioned on adaptor 24 and moved towards shoulder 26. The inner, circumferential ridge 34 of head 22 is of sufficiently large diameter that it may pass over the flanks of the "peak" formations formed by the guide edges 29. However the at least one axial rib 33 is dimensioned such that (unless it is immediately aligned with a groove 28) its lower end encounters a guide edge 29 causing the head 22 to rotate until the lower end of said rib 33 is able to enter an axial groove 28. Furthermore, for this to happen, circumferential rib 34 on the inner surface of head 22 must "snap-past" the upper circumferential ribs 27*u* on the adaptor 24. As head 22 is moved further down, it is constrained to move linearly by virtue of engagement of the at least one axial rib 33 in grooves 28. Head 22 can be moved to a fully closed position by continuing to move the head 22 on the adaptor 24 until the circumferential rib 34 on the inner surface of head 22 "snaps-past" the lower circumferential ribs 27*l* on adaptor 24.

To apply a line of glue to the edge of a sheet of paper, head 22 is positioned on adaptor 24 so that its circumferential rib 34 is positioned just beneath the upper circumferential ribs 27*u* on the adaptor 24. The adhesive rod may now be advanced so that its free end reaches the level of the mouth 32. The edge of the paper is now inserted into the mouth 32, finger pressure is applied to the top of the cap 30 to move the head and the sheet edge together to contact the free end of the glue rod, and the sheet is pulled relatively through the mouth 32. With the continued application of finger pressure, the head 22 is able to move downwardly as the free end of the glue rod is "worn-away", in a manner analogous to that explained in relation to the embodiment of FIGS. 1-4. It will be appreciated that this downward movement of head 22 can continue until its inner circumferential rib 34 encounters the lower ribs 27*l* on adaptor 24.

It will be appreciated that, as with the first embodiment, head 22 may be removed entirely to allow application of adhesive to areas of a paper sheet other than along the edge thereof.

Figure 7:
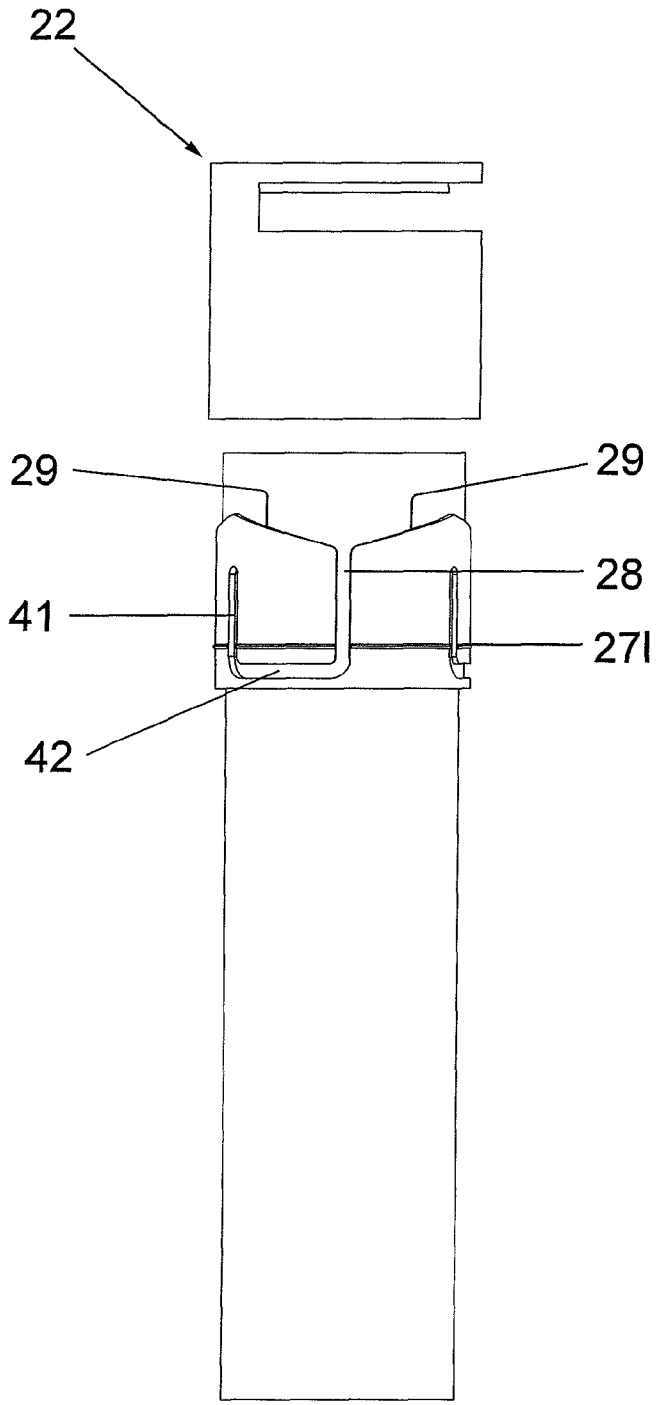
FIG. 7 is an exploded view of a third embodiment of adhesive applicator in accordance with the invention.
Figure 8:
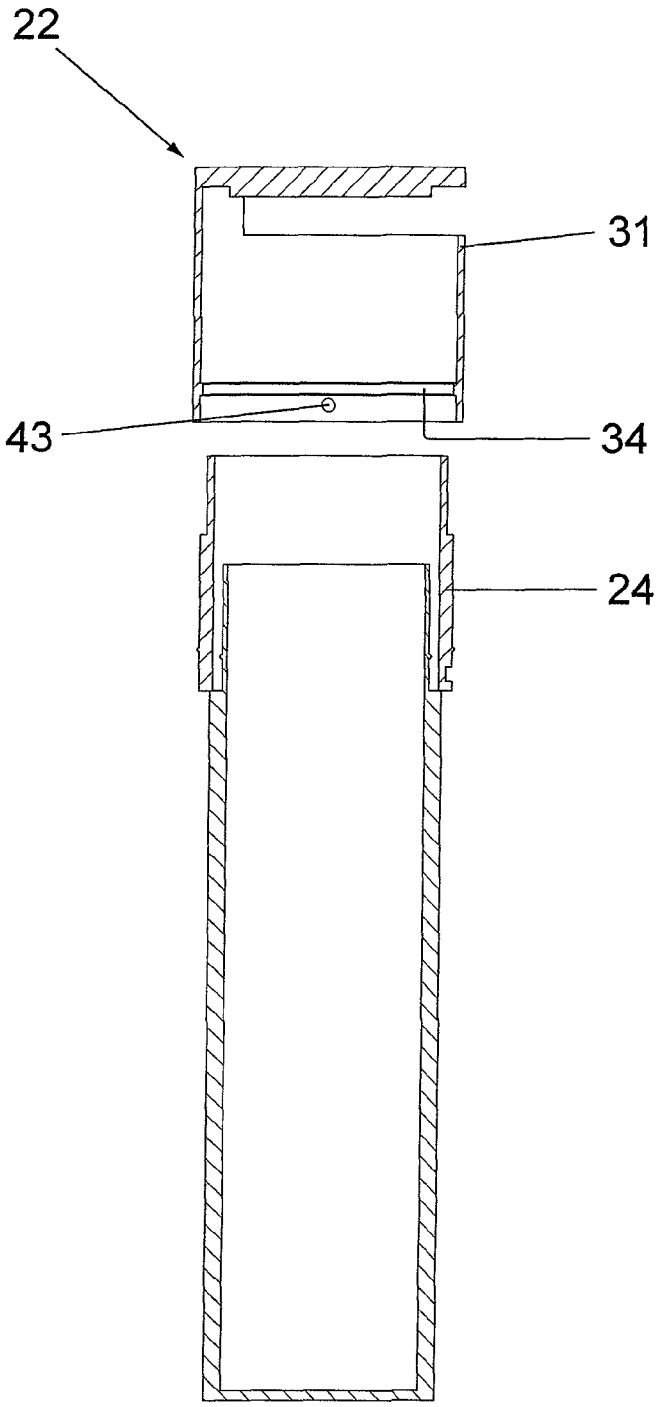
FIG. 8 is similar to FIG. 7 but shows the third embodiment in cross-section.

Turning now to FIGS. 7 and 8, these illustrate a third embodiment of adhesive applicator in accordance with the invention which has some similarity with the second embodiment described in relation to FIGS. 5 and 6. Therefore only these differences will be described and for convenience the same reference numerals will be used to denote like parts.

With regard to the adaptor 24, there are two differences. The first is that there is only one circumferential rib, which is equivalent to rib 27*l* in FIGS. 5 and 6 and therefore denoted in FIG. 7 by the same numeral. Secondly, each axial groove 28 is part of a generally U-shaped groove formation which comprises the groove 28 as one limb, a further groove 41 as the other limb, and a traversal groove 42 connecting the lower ends of grooves 28 and 41. Although this groove formation is shown as being U-shaped, other configurations are possible in which there are two or more grooves 41, with all grooves being connected by a traversal groove.

As compared to the embodiment of FIGS. 5 and 6, the head 22 of the embodiment of FIGS. 7 and 8 is modified so that there are "pins" or "studs" 43 moulded on, and projecting from, the inner surface of the tubular body 31 (as opposed the axial rib 33 in the case of the embodiment of FIGS. 5 and 6).

Assembly of the embodiment of FIGS. 7 and 8 is effected in a similar way to that of the embodiment of FIGS. 5 and 6 in that the head 22 is oriented by the guide edges 29 to cause pins 43 to enter the grooves 28. Head 22 is then moved downwardly until its circumferential rib 34 "snaps-past" the rib 27*l* on the adaptor 24. Head 22 may now be turned to allow the pins 43 to move relatively along the traversal grooves 42 until it comes to the lower end of groove 41. Head 22 may now be moved upwardly so that (with pin 43 travelling upwardly along groove 41) the circumferential rib 34 of the head 22 again "snaps-past" rib 27*l*. Thus head 22 can now move axially of the cylindrical body 21 between an upper position in which pin 43 encounters the upper (closed) end of groove 41 and a lower position beyond which it is necessary for circumferential rib 34 of head 22 again to be "snapped-past" the rib 27*l* on the adaptor 24.

Use of the applicator of FIGS. 7 and 8 for applying a line of adhesive to an edge of a sheet of paper is effected when the head 22 is positioned so that its pin 43 is able to move freely along the grooves 41, but otherwise in a manner entirely analogous to the embodiment of FIGS. 5 and 6.

It will be appreciated that, as with the other embodiments, head 22 may be removed entirely to allow application of adhesive to areas of a paper sheet other than along the edge thereof.

In the embodiments of the invention as thus far described, axial movement of the head has been effected by movement of a projection (e.g. a rib or pin) provided on the inner surface of the head along a linear groove on the body portion. It is however possible for the cap to be rotatably mounted on the body such that rotation of the cap also results in axial movement thereof along the body. Such an arrangement is shown in FIGS. 9 and 10 as a fourth embodiment of the invention.

Figure 9:
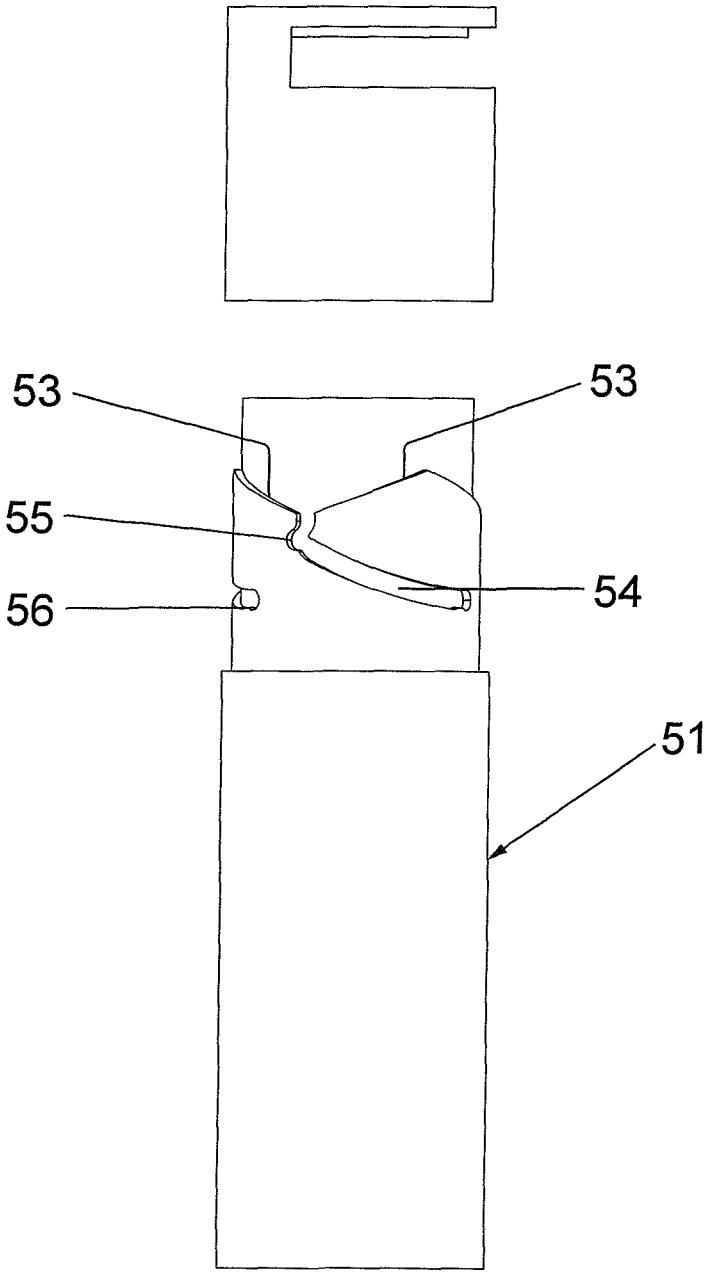
FIG. 9 is an exploded view of a fourth embodiment of adhesive applicator in accordance with the invention.
Figure 10:
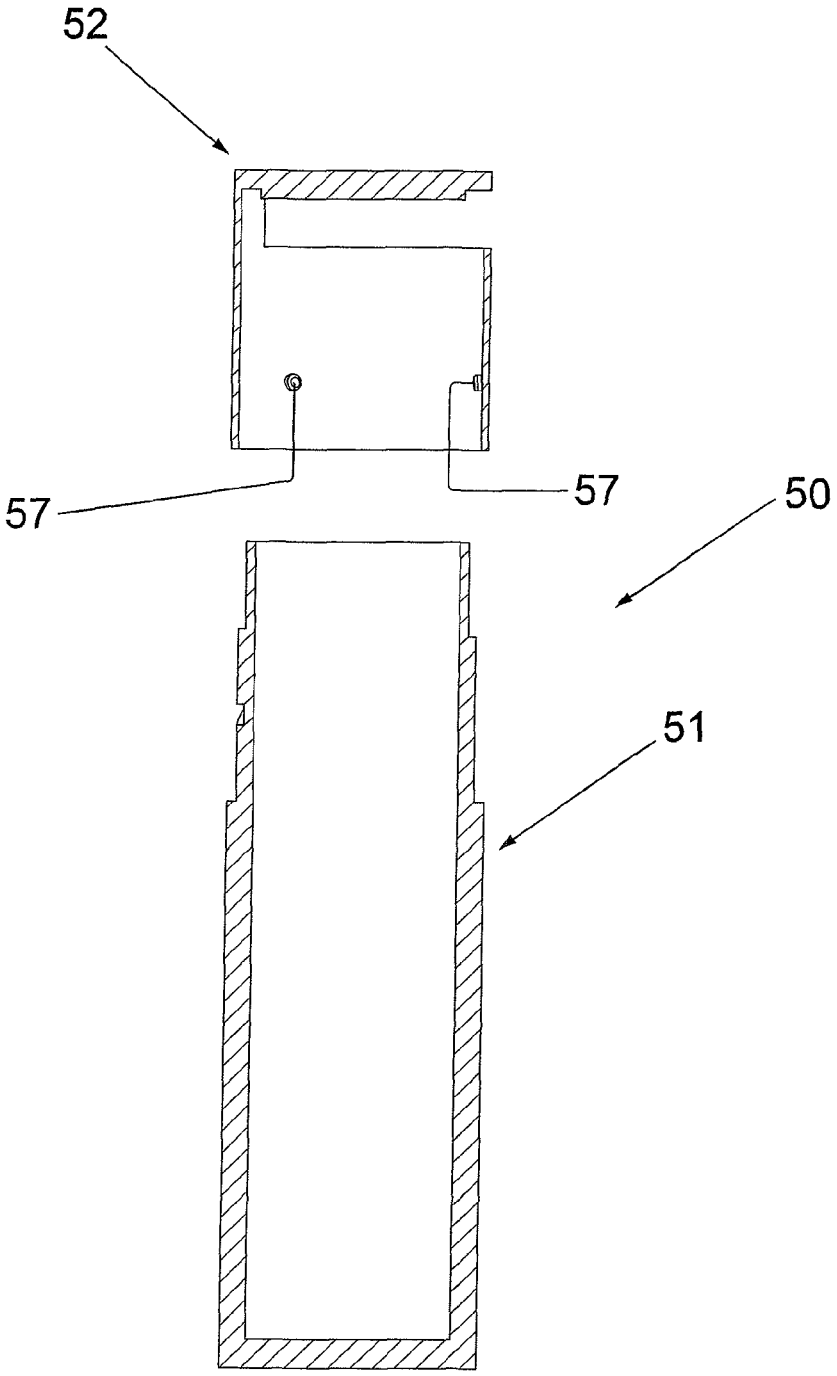
FIG. 10 is a sectional view of the fourth embodiment of adhesive applicator illustrated in FIG. 9.

FIGS. 9 and 10 illustrate an adhesive applicator 50 comprised of a body 51 and a head 52. Body 51 is shown as a one-piece moulded component but could equally well be formed in separate parts, as for the earlier described embodiments. The upper portion of body 51 is shown as being formed with guide edges 53 which was similar to the guide edges 29 shown in relation to the embodiment of FIGS. 5 and 6. However the axial grooves 28 of that embodiment are replaced, in the embodiment of FIGS. 9 and 10, by grooves 54 which, from a position at which two guide edges 53 meet, extend downwardly and part-circumferentially around the body 51. Towards their upper ends, the grooves 54 are associated with a holding section 55 and towards their lower ends with a stop formation 56.

Inner surface of the cap 52 is formed with integrally moulded pins 57

When locating cap 52 onto body 51, the pins 57 are guided by edges 53 so that they enter holding section 55 of the groove 54, for which there is slight rotational movement of the head 52 in one direction subsequent to which the head may be rotated in the opposite direction to allow the pins 57 to traverse downwardly along the arcuate section of groove 54 until it reaches the stop formation 56. The holding section 55 and stop formation 56 define first and second limit positions for the rotational (and hence axial) movement of the head 52.

When applying adhesive to the edge of a sheet of paper, head 52 is positioned so that pins 57 are in the holding section 55 towards the upper end of groove 54. As in the case of the previous embodiments, the edge of the paper is inserted into the mouth of the head 52 and the glue rod advanced to contact the paper. Finger pressure is applied to the top of head 52 and the edge of paper drawn through the mouth. As the end of the glue rod "wears-away", the continued finger pressure causes the pins 57 to move relatively downwardly along the groove 54, resulting in axial movement of the head 52 along the body 51 to allow the paper to remain in contact with the glue rod.

The head may be moved to a fully closed position for the applicator by causing the pins 57 to move past the stop formation 56. As with other embodiments, the head 52 may be removed completely from the applicator 50, in this case by rotation of the head 52 so that the pins 57 move upwardly along groove 54 into holding section 55 from which they may be moved out of the groove.

Figure 11:
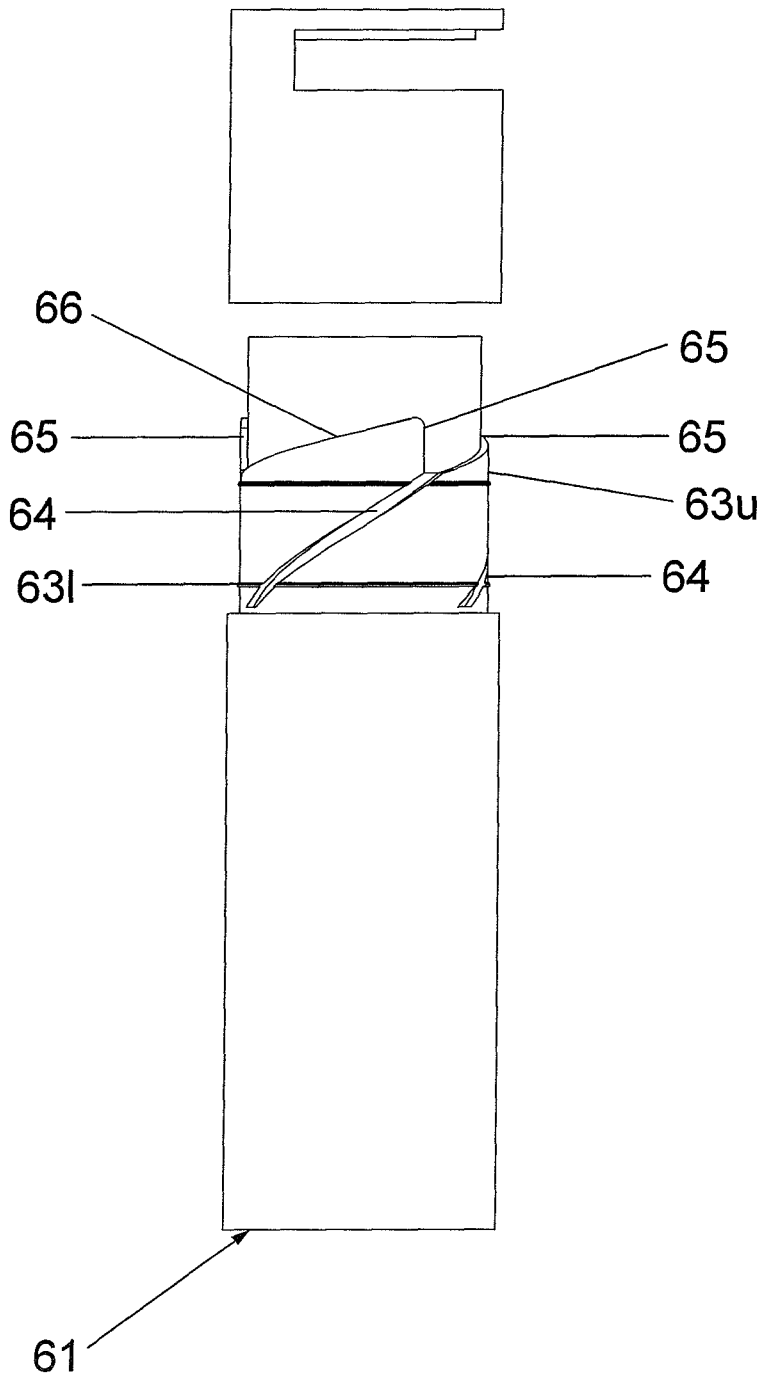
FIG. 11 is an exploded view of a fifth embodiment of adhesive applicator in accordance with the invention.
Figure 12:
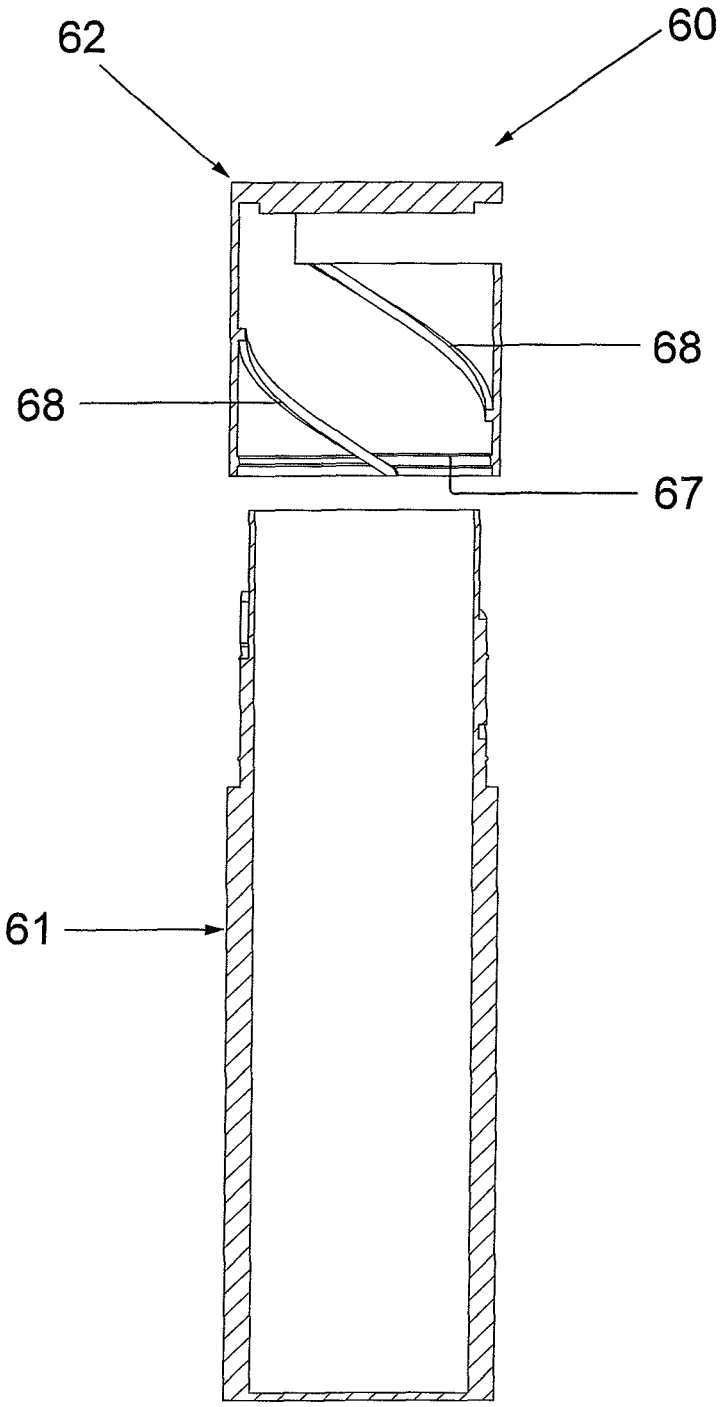
FIG. 12 is a sectional view of the fifth embodiment of adhesive applicator illustrated in FIG. 11.

FIGS. 11 and 12 illustrate a fifth embodiment of the invention in which, as in the case of the previous embodiment, rotation of the head provides for axial movement thereof along the body. The adhesive applicator 60 illustrated in FIGS. 11 and 12 comprises a body 61 and head 62. Body 61 is shown as being moulded as a single plastics component but could be formed in two parts. In this fifth embodiment, the upper portion of body 61 is formed with upper and lower ribs 63*u* and 63*l* respectively and is additionally formed with two generally helical grooves 64 that interrupt the ribs 63*u* and 63*l*. At one side of the entrance to each groove 64 is a shoulder 65, from the upper end of which leads a guide edge 66 terminating at the other groove 64.

Within the head 62 is a circumferential rib 67 of internal diameter such as to be capable of locating with slight clearance over the shoulder 65 and guide edges 66. Also provided within the head 62 are two part-helical ribs 68 which are complementary to the grooves 64.

To assemble applicator 60, head 62 is positioned on body 61 until the lower ends of helical ribs 68 (within head 62) contact guide edges 66. The head 62 is now rotated so that the lower ends of the helical ribs 68 reach the entrance to grooves 64 and are temporarily prevented from moving past by the shoulder 65. Continued rotation of the head 62 and application of pressure thereto allows the circumferential rib 67 of the head 62 to "snap-past" upper rib 63*u* on the body 61 and for the helical ribs 68 to advance along the helical grooves 64 so that there is linear movement of the head 62 relative to the body 61. With continued movement of the head 62, the circumferential rib 67 thereof may be "snapped-past" the lower peripheral rib 63*l* on body 61 so as to locate head 62 in the fully closed position.

The applicator 62 is used in a manner entirely analogous to that described for the embodiments of the previous figures, it being appreciated that the application of adhesive to the edge of the paper is effected whilst the circumferential rib 67 of head 62 is located between the ribs 63*u* and 63*l* on the body 61.

Figure 13:
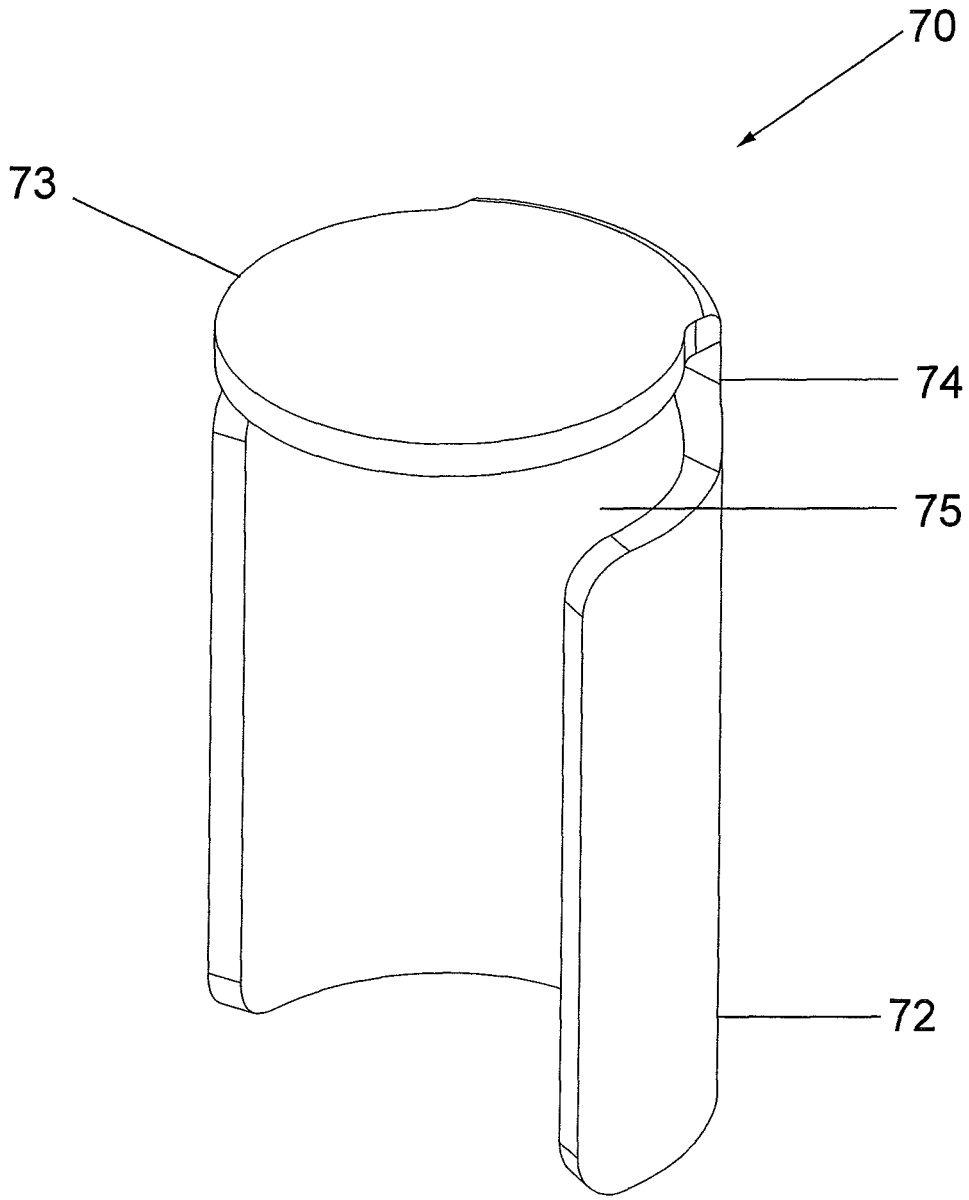
FIG. 13 is a perspective view of one embodiment of adaptor unit in accordance with the second aspect of the invention.
Figure 14:
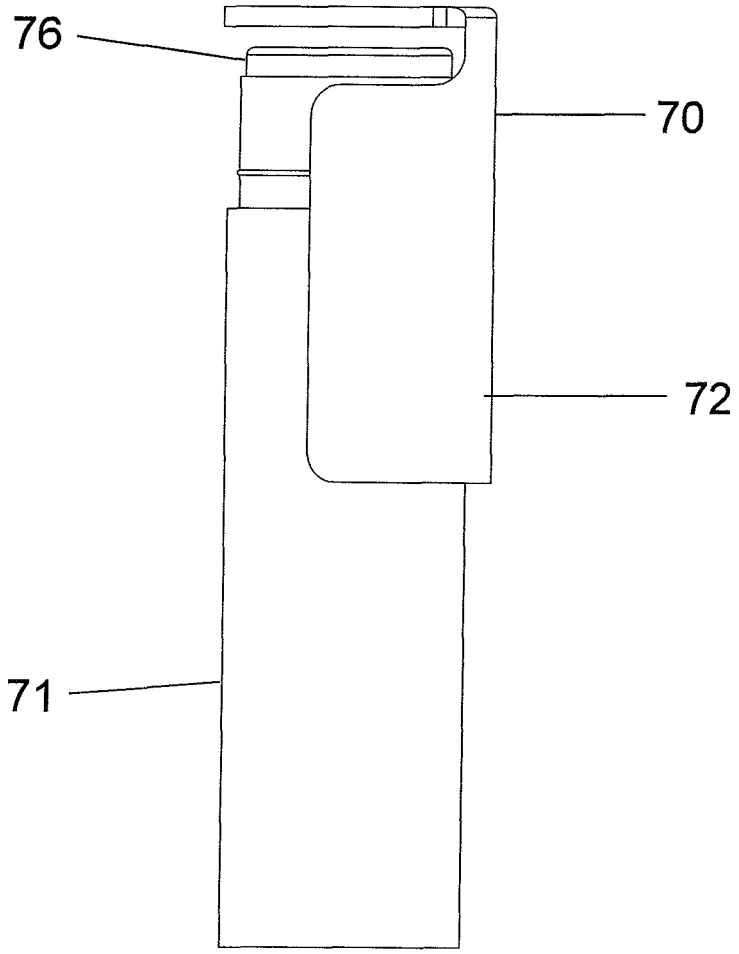
FIG. 14 shows the adaptor unit of FIG. 13 fitted to an adhesive applicator.

Reference is now made to FIGS. 13 and 14 which relate to an embodiment of the second aspect of the invention. FIG. 13 shows an adaptor 70 for clipping onto a conventional "glue stick" adhesive applicator. FIG. 14 shows the adaptor 70 mounted on applicator 71. Adaptor 70 comprises a generally C-shaped body 72 and a disk-like cap 73 connected to the body 72 by a neck 74. As shown in FIG. 13, a mouth 75 is defined by the upper edges of the body 72 and the undersurface of cap 73.

Body 72 serves to clip the adaptor 70 onto the applicator 71, in the manner clearly illustrated in FIG. 14. When so mounted, finger pressure on the upper surface of cap 73 allows the adaptor 70 to move downwardly relative to applicator 71.

With specific reference to FIG. 14, it will be appreciated that the assembly of the adhesive applicator 71 and adaptor 70 is used in exactly the same manner as previous embodiments. Thus, the glue rod (referenced in FIG. 14 as 76) is advanced into the mouth 75 so that a sheet of paper (not shown) may be located between the free end of the glue rod and the undersurface of cap 73, with the paper edge located against the vertical edges of neck 74 which serve as a guide. Also as clearly represented in FIG. 14, the paper is capable of being inserted into the mouth 75 by a sufficient distance so that the majority, and preferably the entire, cross-section of the free end of the glue rod 76 may apply adhesive to the paper. In different embodiments the mouth 75 may however be configured to allow insertion of a sheet of paper to other degrees.

In a modification of the embodiment illustrated in FIGS. 13 and 14, the body 72 is configured not as a clip (as currently shown) but rather as a tube that may be located over the end of the applicator.

Reference is now made to FIGS. 15 to 18 which illustrate a sixth embodiment of adhesive applicator in accordance with the invention.

Figure 15:
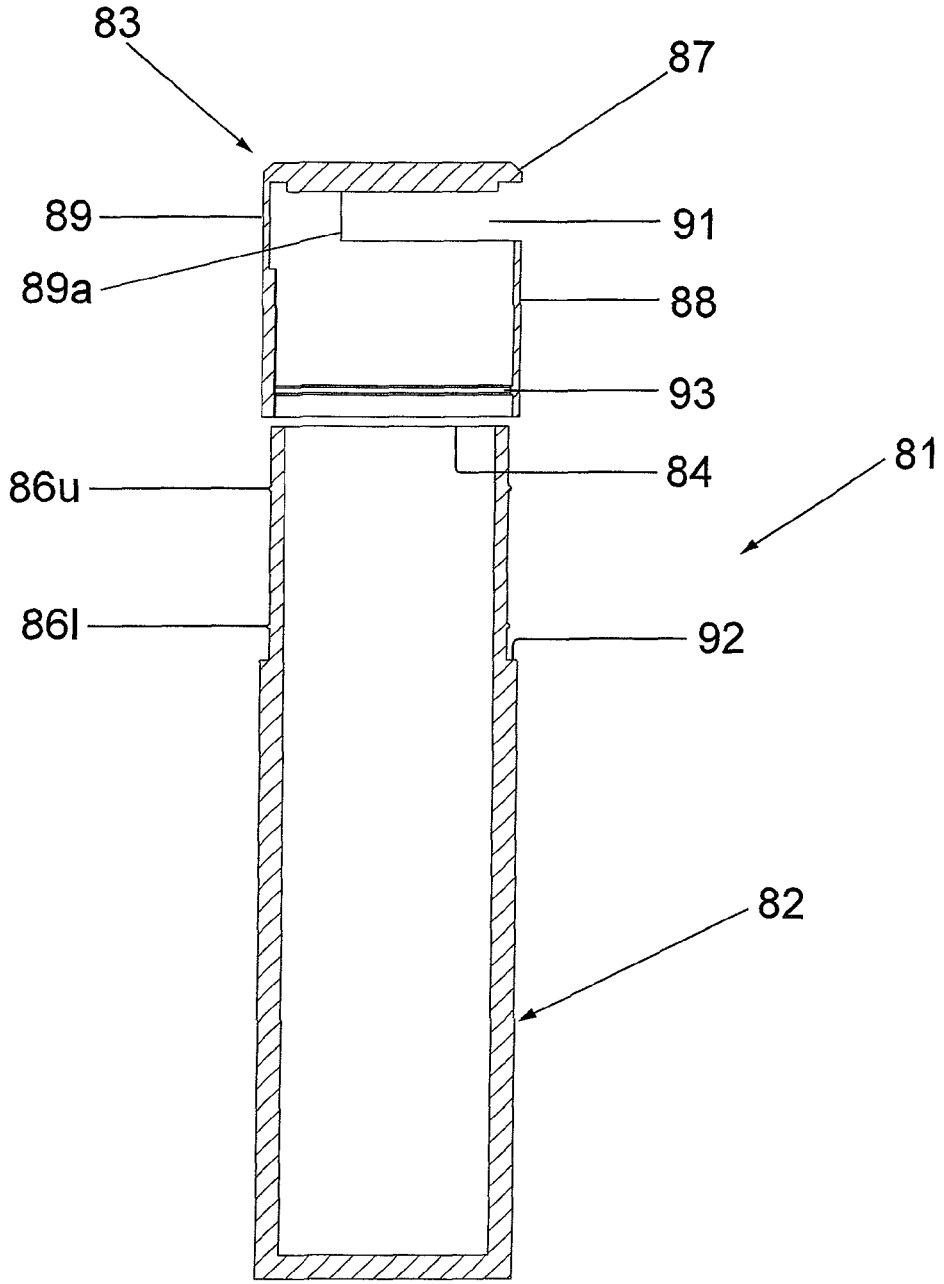
FIG. 15 is an exploded, sectional view of a sixth embodiment of glue applicator in accordance with the invention shown with the head of the applicator separated from the body thereof.

As shown in FIG. 15, a glue applicator 81 in accordance with the sixth embodiment of the invention comprises an elongate cylindrical body 82 and a removable head 83 (shown in FIG. 15 as being removed from the body 82). Head 83 is the component part of the adhesive applicator 81 that facilitates application of a line of adhesive along an edge of a sheet of paper or other substrate to which adhesive is to be applied. Cylindrical body 82 is illustrated as being a single moulded component. Within cylindrical body 82 is a glue rod (omitted from the drawings for the purposes of clarity). This glue rod may be of conventional composition as used in commercially available adhesive applicators of the type known as "glue sticks". This glue rod may be advanced and retracted along the body 82 by means of a screw mechanism (again omitted from the drawings for the purpose of clarity) of the type used for this purpose in commercially available glue applicators.

The inner surface of body 82 is generally smooth but the external surface of body 82 is provided with two sets of axially spaced ribs 86, as an uppermost set 86*u* and a lowermost set 86*l*. Both sets of ribs 86*l* and 86*u* extend the full way around the inner peripheral surface of body 82 and are located just above a shoulder 92 of body 82 and below an open end 84 of body 82 respectively. The function of the ribs 86*l* and 86*u* will be described more fully below.

In the assembled applicator, the head 83 is mounted on the body 82 in the manner described more fully below. This combination of head 83 and body 82 forms a closure for the adhesive, but head 83 may be fully removed from body 82 to facilitate traditional use of the glue stick body.

Head 83 is a one-piece plastics moulded component formed in three principal parts, namely an upper, disc-like cap 87 with a flat undersurface, a tubular guide body 88 connected to the undersurface of the cap 87 by an arcuate strut 89 which is a "part-extension" of the cylindrical wall of body 88. Tubular guide body 88 is dimensioned such that it locates externally of body 82.

As will be appreciated from FIG. 15, a mouth 91 (in the form of an elongate slit) is formed between the undersurface of cap 87 and the upper edge of tubular guide body 88. The roof of the mouth 91 is provided by the flat undersurface of cap 87, the lower portion of the mouth 91 is provided by flat upper edges of the tubular body 88, and the rear of the mouth is provided by vertical (as seen in FIG. 15) guide edges 89*a* on the strut 89. As will be appreciated from the fuller description given below, the mouth 91 is for the purpose of accommodating an edge of a sheet of paper (or other substrate) to which adhesive is to be applied and is configured so that the majority of the cross section of the free end of the glue rod may be applied to the paper (or other substrate).

To this end, strut 89 extends only a relatively short distance around the circumference of the tubular body 88 to permit insertion of the edge of a sheet of paper into the mouth 91 sufficiently far so that the majority of the cross-section of the glue rod can contact the edge of the paper. In different embodiments the mouth may however be configured to allow insertion to other degrees.

Formed in tubular body 88 is an additional circumferential rib 93 of sufficiently large diameter that it may pass over the outer surface of body 82 but must be "snapped" over ribs 86*u* and 86*l*.

In the assembled applicator, head 83 is mounted on the body 82 by virtue of the tubular body 88 of the former locating externally of the latter. Head 83 is moved towards the shoulder 92 of body 82 and must be "snapped" past rib 86*u*.

Figure 16:
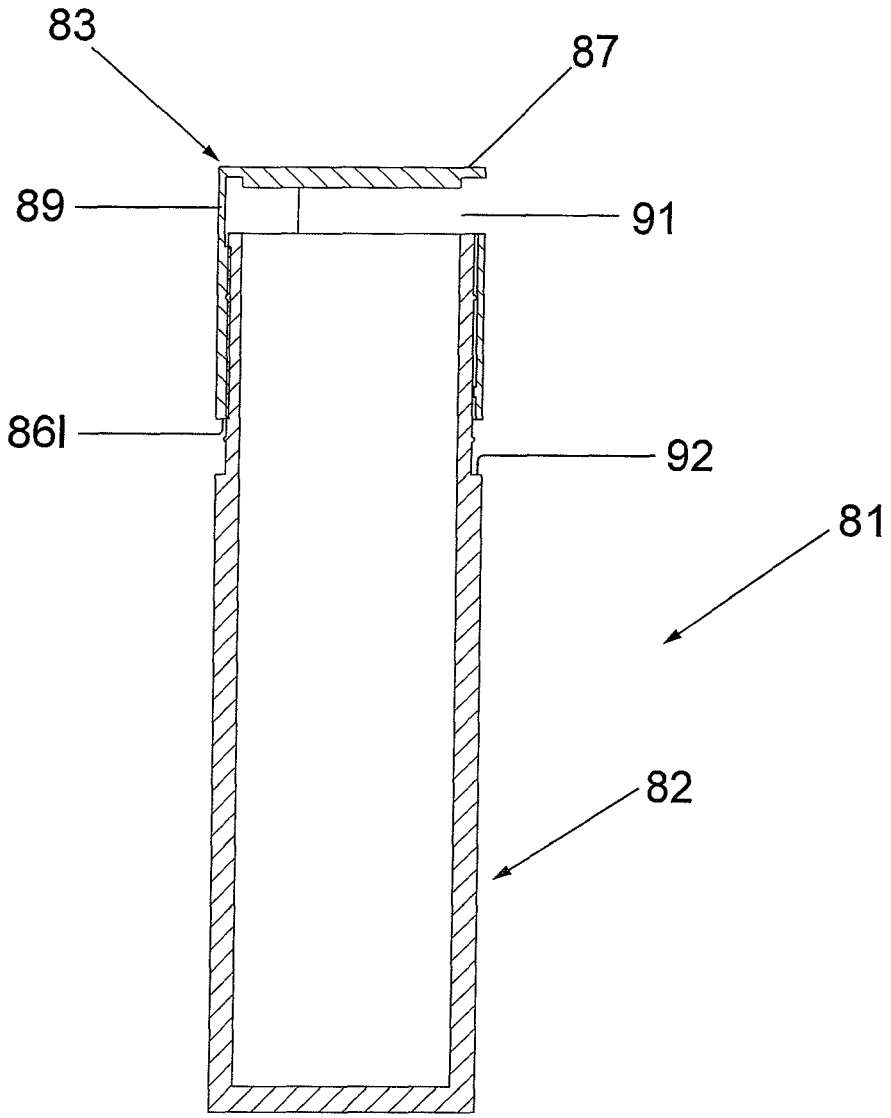
FIG. 16 is a sectional view of the applicator illustrated in FIG. 15 showing the head assembled on the body and in an "open" position for gluing an edge of a paper sheet.

With the head 83 and body 82 mounted together in this way (as shown in FIG. 16) the head 83 may be freely moved between the lower rib 86*l* adaptor and the upper rib 86*u*. Body 82 and head 83 may be fully closed by further moving head 83 towards the shoulder 92 of body 82. In doing so the circumferential rib 93 is "snapped past" the lower rib 86*l* on body 82 to form a secure closure as shown in FIG. 17.

Figure 18:
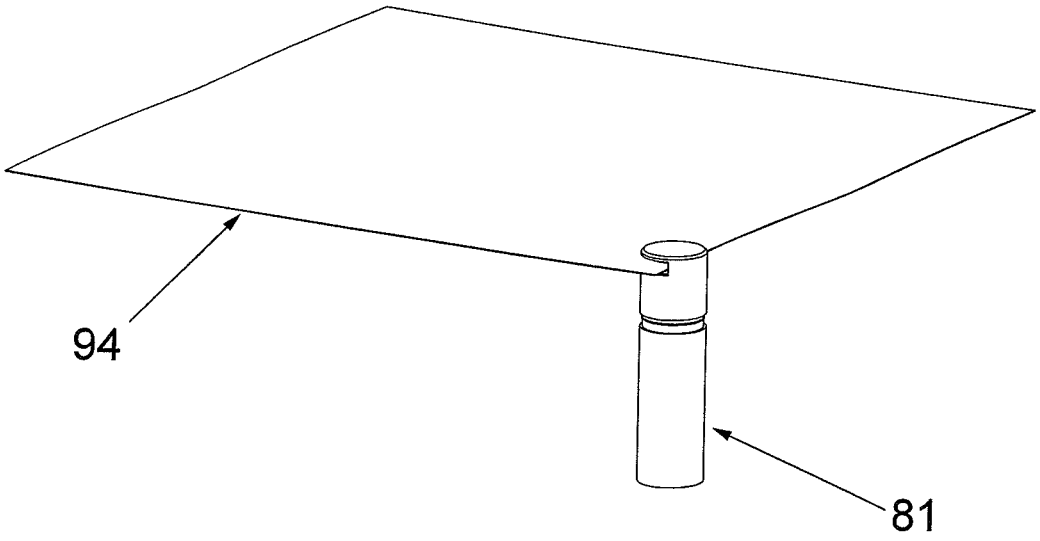
FIG. 18 shows the assembled applicator of FIG. 15 in use in gluing an edge of a paper sheet.

Reference is now made to FIG. 18 which shows use of the applicator 81 in applying adhesive to a marginal edge region of a sheet of paper (or other flat substrate), referenced as 94. In order to apply glue to the edge of a sheet of paper (or other substrate) the head 83 is moved upwardly to the position shown in FIG. 16. The glue rod is advanced by the aforementioned screw mechanism so that the free end of the glue rod is positioned slightly below the mouth 91. The adhesive rod is now advanced to the upper edges of the tubular body 88. The edge of the paper (or other substrate) is then inserted fully into mouth 91 until the paper reaches guide edges 89*a*. The head 83 is now advanced under pressure until the undersurface of cap 87 meets the upper surface of the edge of paper and in so doing pressing the undersurface of the edge of paper against the free end of the glue rod. The applicator 81 is then run relatively along the edge of the paper (as shown in FIG. 18), the edge of the paper being guided by the vertical edges 89*a* of strut 89. As the glue is applied, the free-end of the glue rod "wears-away" (i.e. due to the transfer of glue for the rod to the paper). By the continued application of finger pressure to the cap 87, the head 83 is able to move downwardly towards the shoulder of body 82 between ribs 86*u* and 86*l* (this move being allowed by the relative movement of the circumferential rib 93 in the axial direction between ribs 86*u* and 86*l*) and the edge of the paper 94 remains in continuous contact with the glue rod and a coating of adhesive is applied to the edge, this coating being uniform in both thickness and width (due to guiding of the paper by the edges 89*a*).

Application of the adhesive is terminated when the sheet is withdrawn from the applicator.

Figure 17:
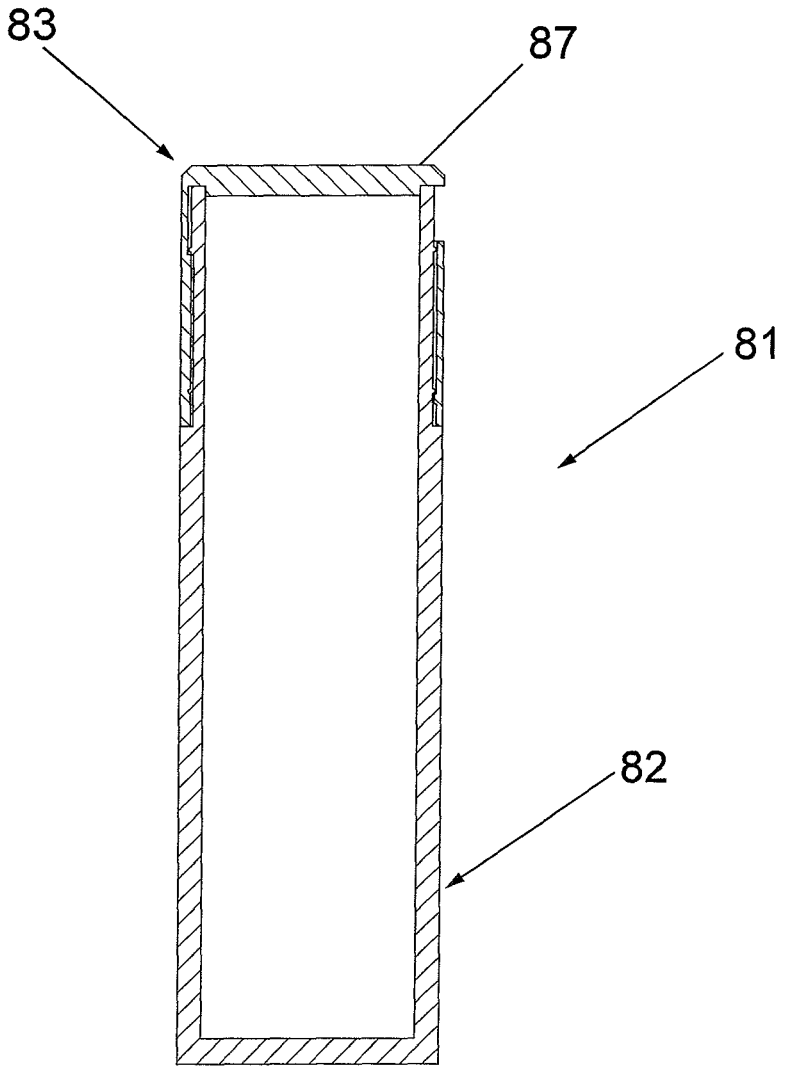
FIG. 17 is a sectional view showing the applicator of FIG. 15 in an assembled configuration with the head in a "closed" position.

When it is desired to close the applicator, the head 83 may be moved fully downwards to the position shown in FIG. 17, it being noted that the undersurface of cap 87 is configured to be located within the top of body 82

If it is desired to use the applicator 81 to apply adhesive to a region of paper other than the edge then the cap 83 may be removed by the reverse of the procedure described above so that adhesive may be applied as required.

In all of the illustrated embodiments, finger pressure is used to ensure that the applicator head moves downwardly relative to the body as the free end of the glue rod is worn away during application of adhesive to paper. In alternative embodiments, the applicator head may be modified such that the requisite pressure is applied to the head by pressing the latter against a fixed surface (e.g. a desktop) along which the applicator is run to apply adhesive to the edge. This formation may be one which assists in linear movement of the applicator along the surface. The formation may, for example, be a nipple on the upper surface of the head. Alternatively the formation may be a small wheel, again provided on the heads upper surface, the wheel being positioned so as naturally to move in the direction parallel to the paper's edge. Alternatively the formation may be a ball configured to rotate in all directions (a "roller-ball"). The applicator naturally moves in a direction parallel to the paper's edge (whereas it will be appreciated that the aforementioned "roller-ball" is able to move freely in all directions).

Figure 19:
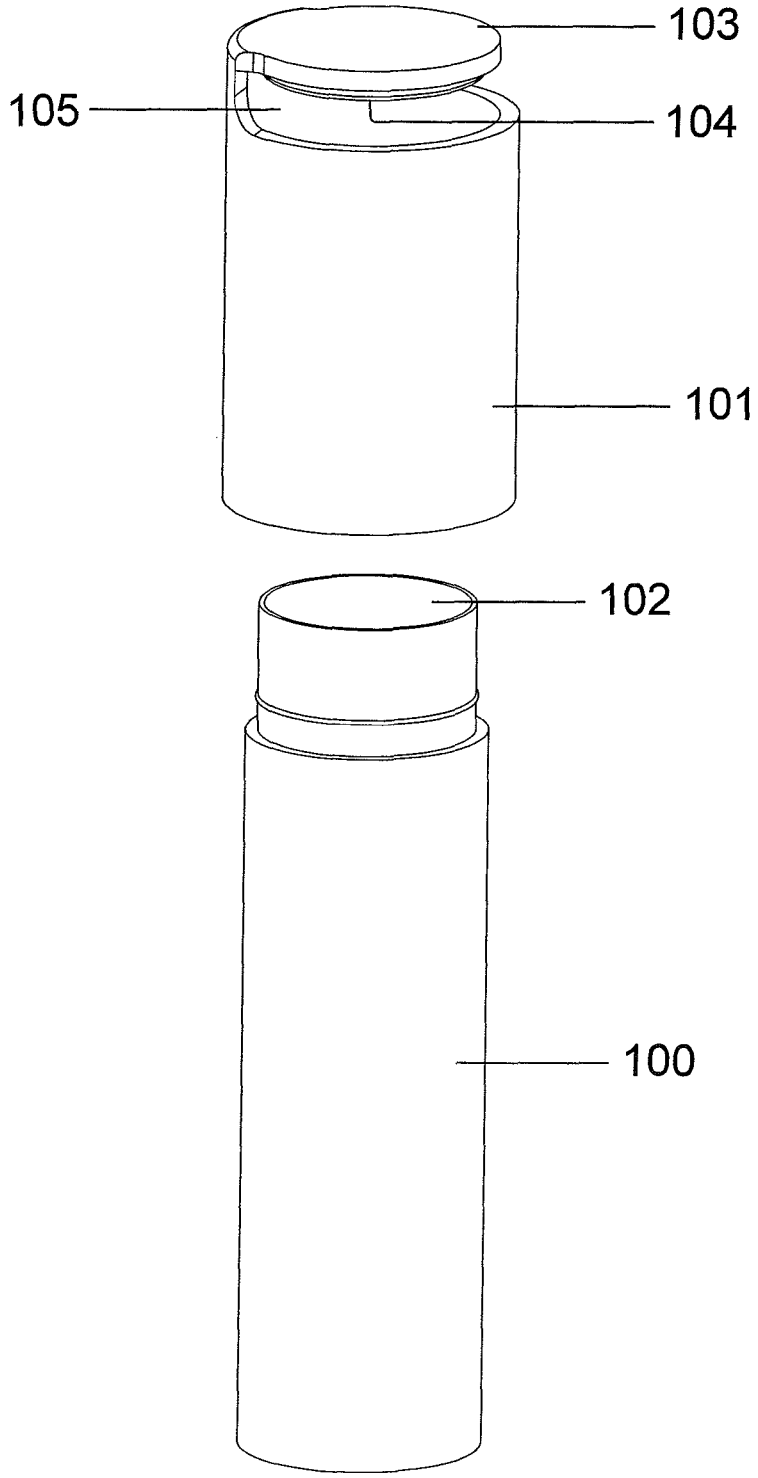
FIGS. 19 to 27 show alternative embodiments of the invention.

FIG. 19 shows a further embodiment of the invention wherein a conventional glue stick cylindrical body (100) is provided with a removable head (101), arranged to slide over the cylindrical body (100) to open or close the opening (102) of the glue stick containing compartment within the body (100). The upper surface (103) of the moveable head (101) is flat and arranged to be pushed against a work surface, for example a desk top to press the contact surface (104) against a sheet of paper or other material inserted into slot (105) in use. The surface (103) may be coated with a low friction or lubricious material such as PTFE. The surface (103) may be depressed manually by a user's finger or thumb, allowing the glue stick to be used in an upright position as shown in FIG. 19.

Figure 20:
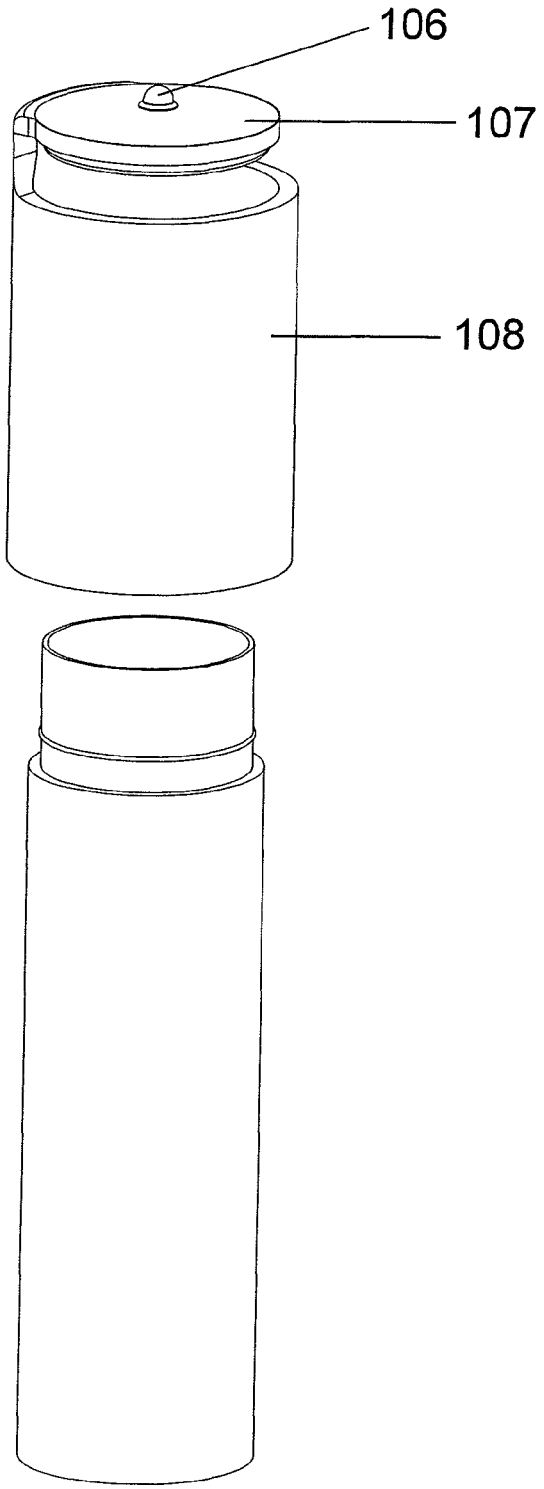

FIG. 20 shows a similar embodiment wherein a hemispherical or otherwise rounded projection (106) is provided on the upper surface (107) as the head (108) is pushed against a work surface.

Figure 21:
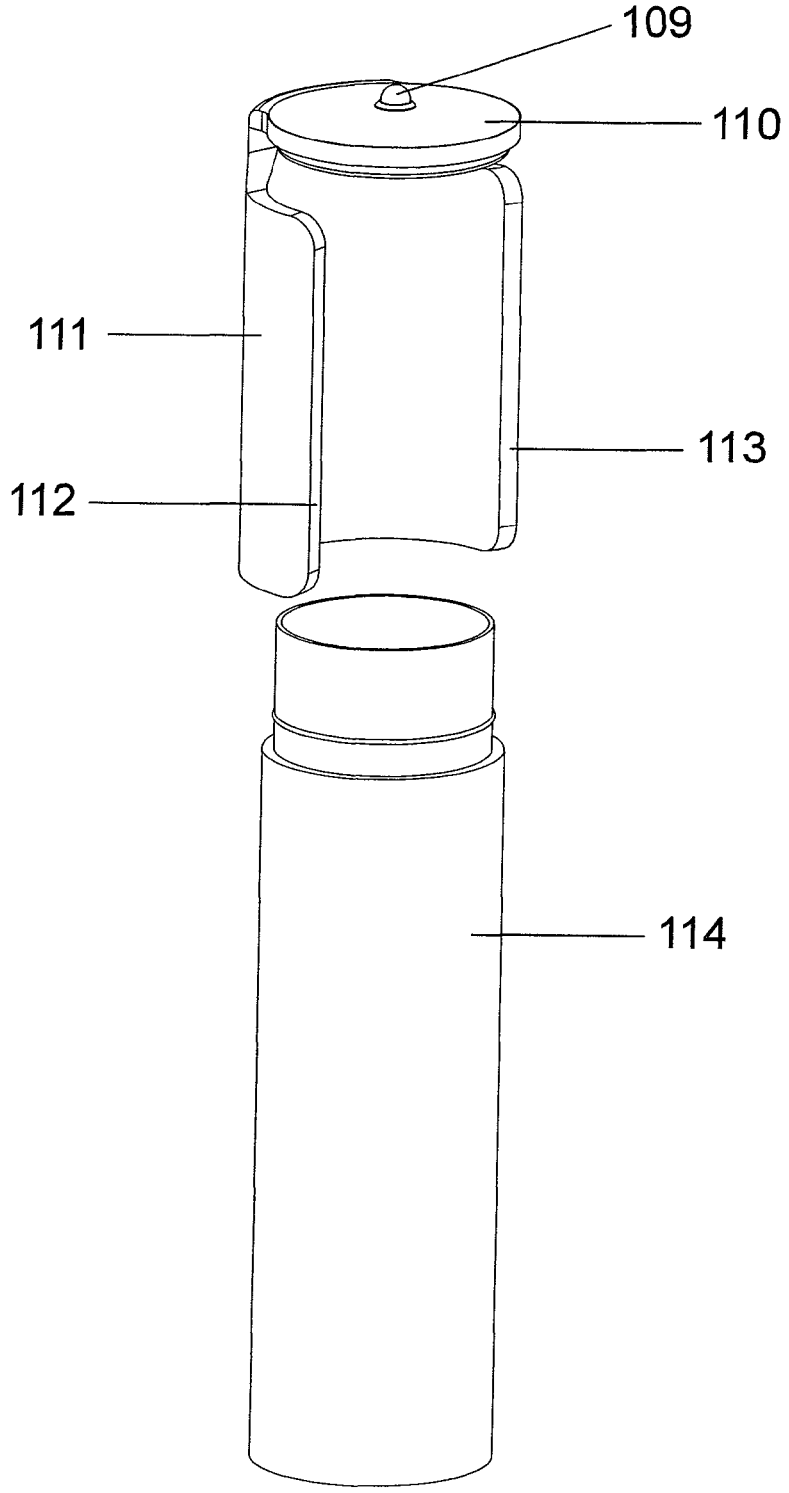

FIG. 21 shows a further embodiment having a projection or nipple (109) on the upper surface (110) as previously described. The head (111) has two limbs (112,113) arranged to form a snap fit around the body (114). In this way the head may be used with a conventional glue stick and may be easily snapped onto or removed from the glue stick as required.

Figure 22:
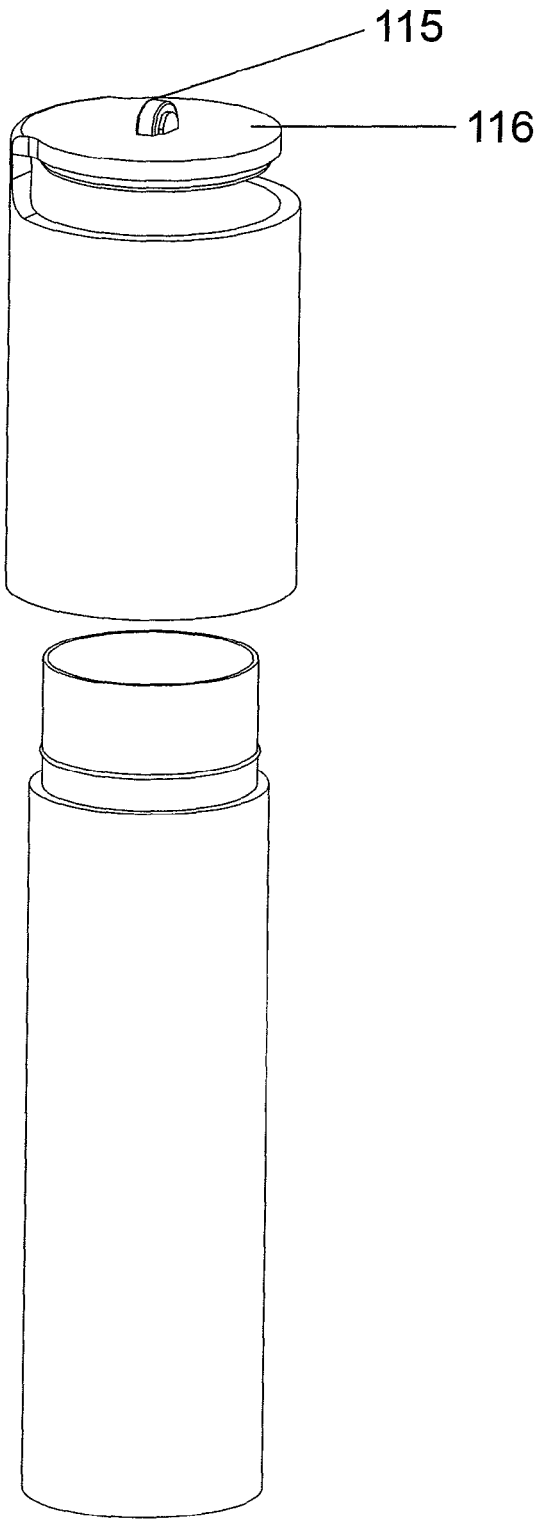

FIG. 22 shows an embodiment similar to that shown in FIG. 20 wherein a wheel (115) is mounted for rotation parallel to the surface (116) of the head to facilitate movement of the head along the surface of a worktop in use.

Figure 23:
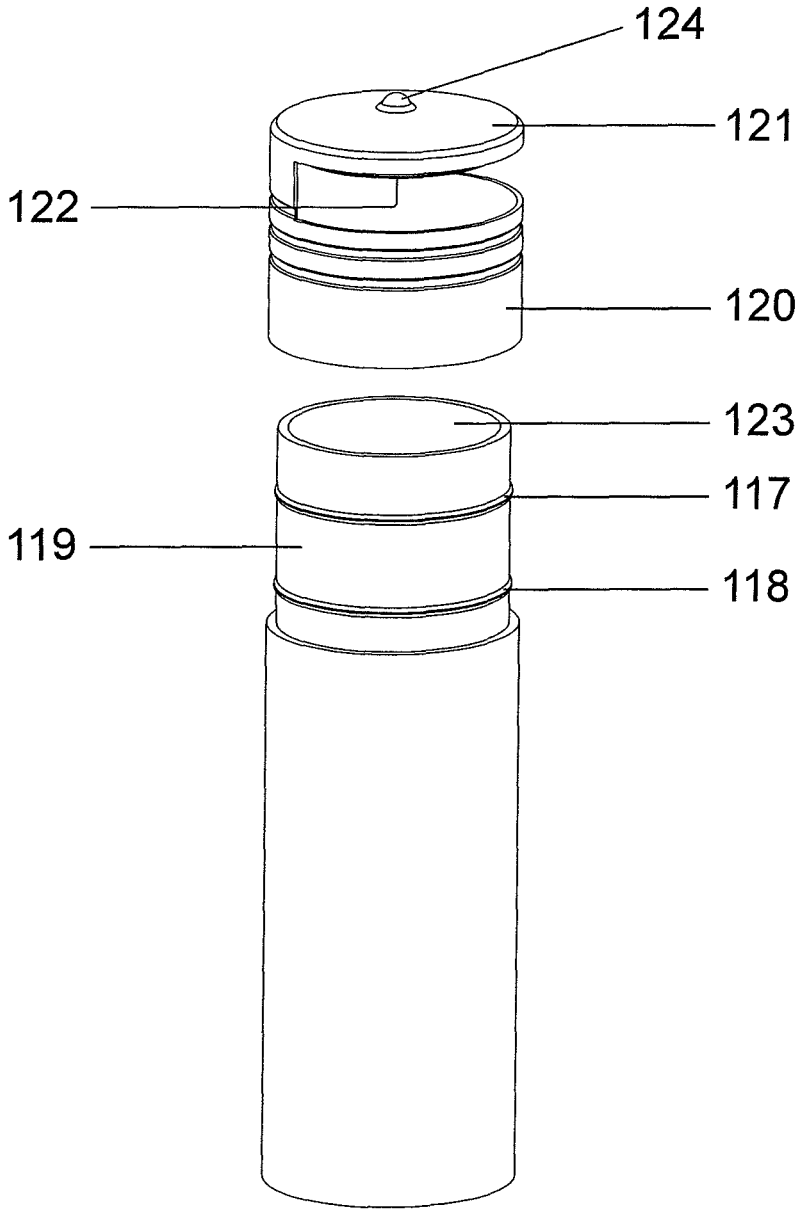

FIG. 23 shows a further embodiment in which upper (117) and lower (118) ribs on the tube body (119) provide a snap fit for the head (120). An internal rib (not shown) is constrained to move between the ribs (117) and (118) during normal use of the applicator. When the head is to be closed to seal the glue stick compartment the upper surface (121) is pushed downwardly so that the internal rib (not shown) is urged past the lower rib to purge the sealing surface (122) into engagement with the opening (123) to form an airtight seal. A projection (124) which may be hemispherical, domed or otherwise rounded allows for low friction movement across the surface of a desk top.

Figure 24:
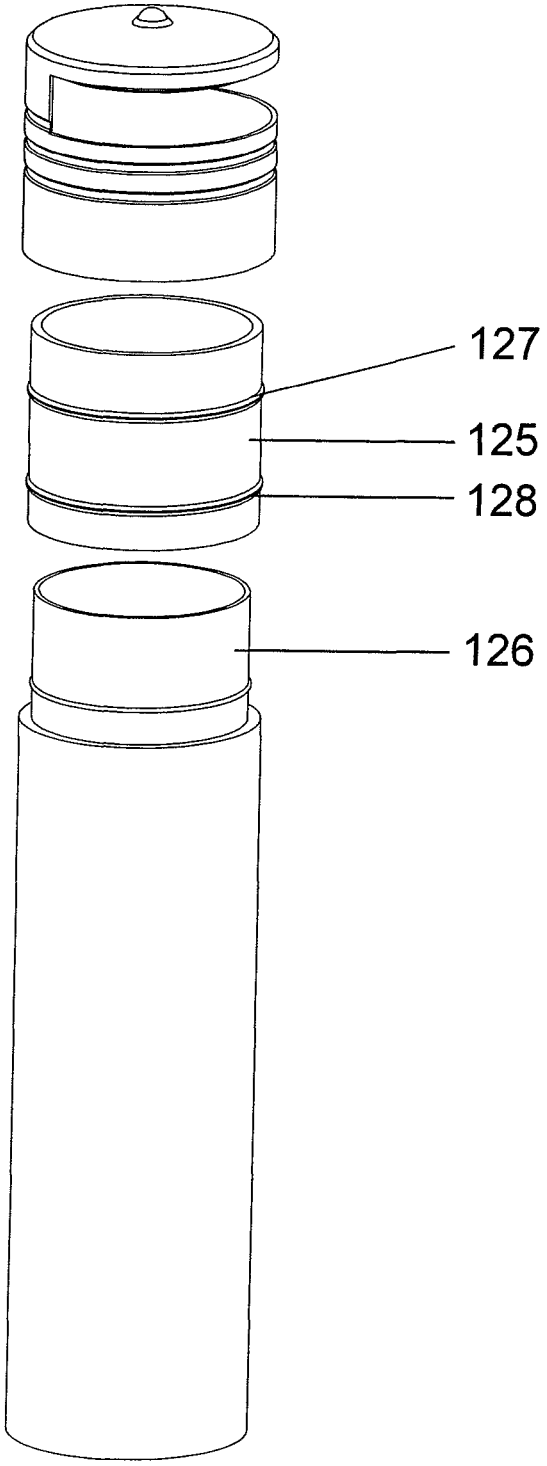

FIG. 24 shows an embodiment similar to that in FIG. 23 except that an adapter tube (125) is arranged to fit onto the head of a standard tube body (126). The adapter (125) has upper (127) and lower (128) ribs as previously described.

Figure 25:
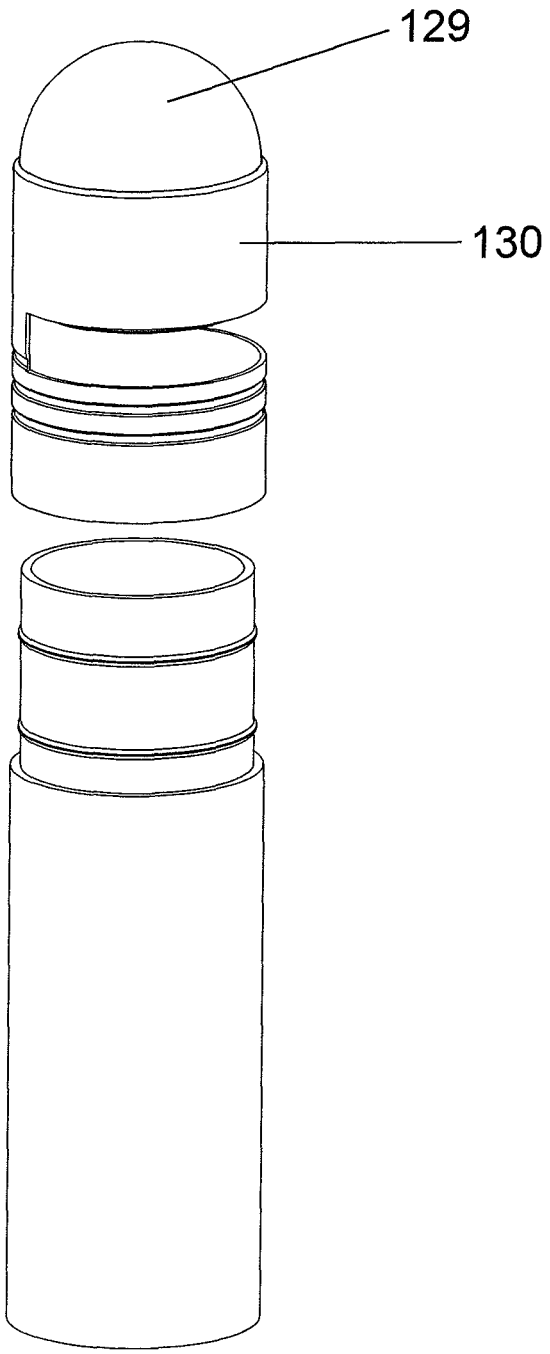

FIG. 25 shows an embodiment similar to that in FIG. 23 except that a roller ball (129) is captively mounted in a socket in head (130) so that rolling contact with a work surface such as a desk top may be provided in use.

Figure 26:
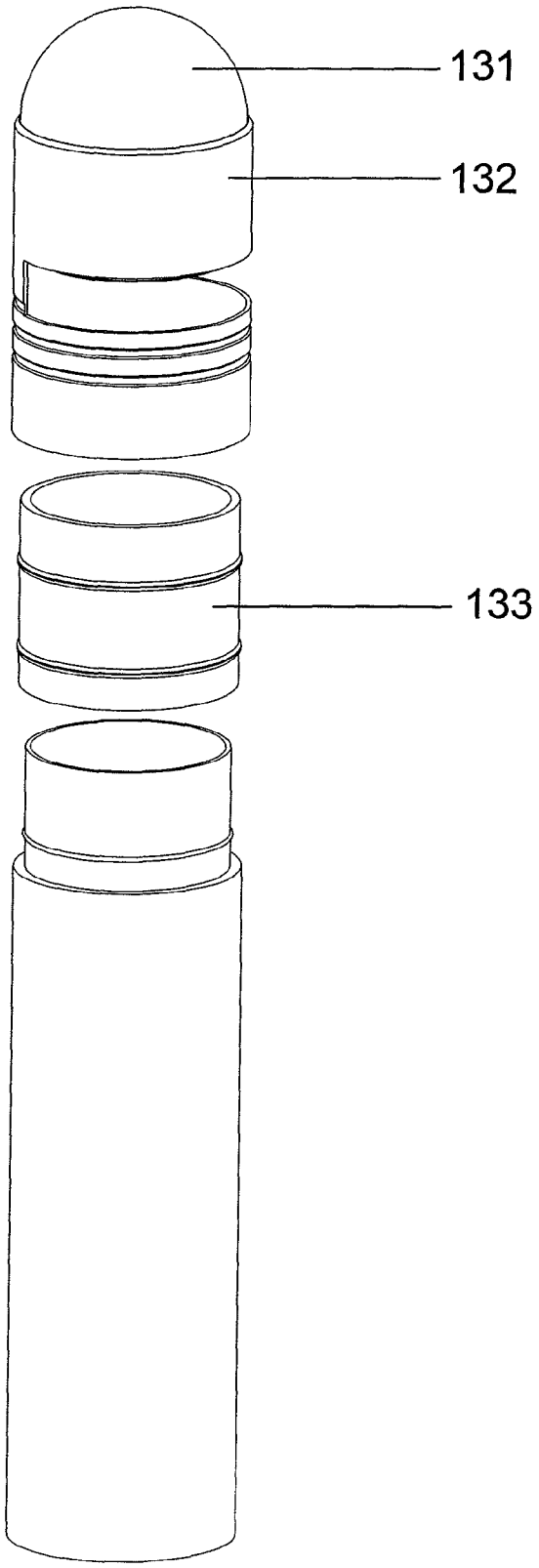

FIG. 26 shows an embodiment wherein the roller ball (131) mounted in a socket in the head (132) is arranged to be mounted on an adapter (133) as described in FIG. 24.

Figure 27:
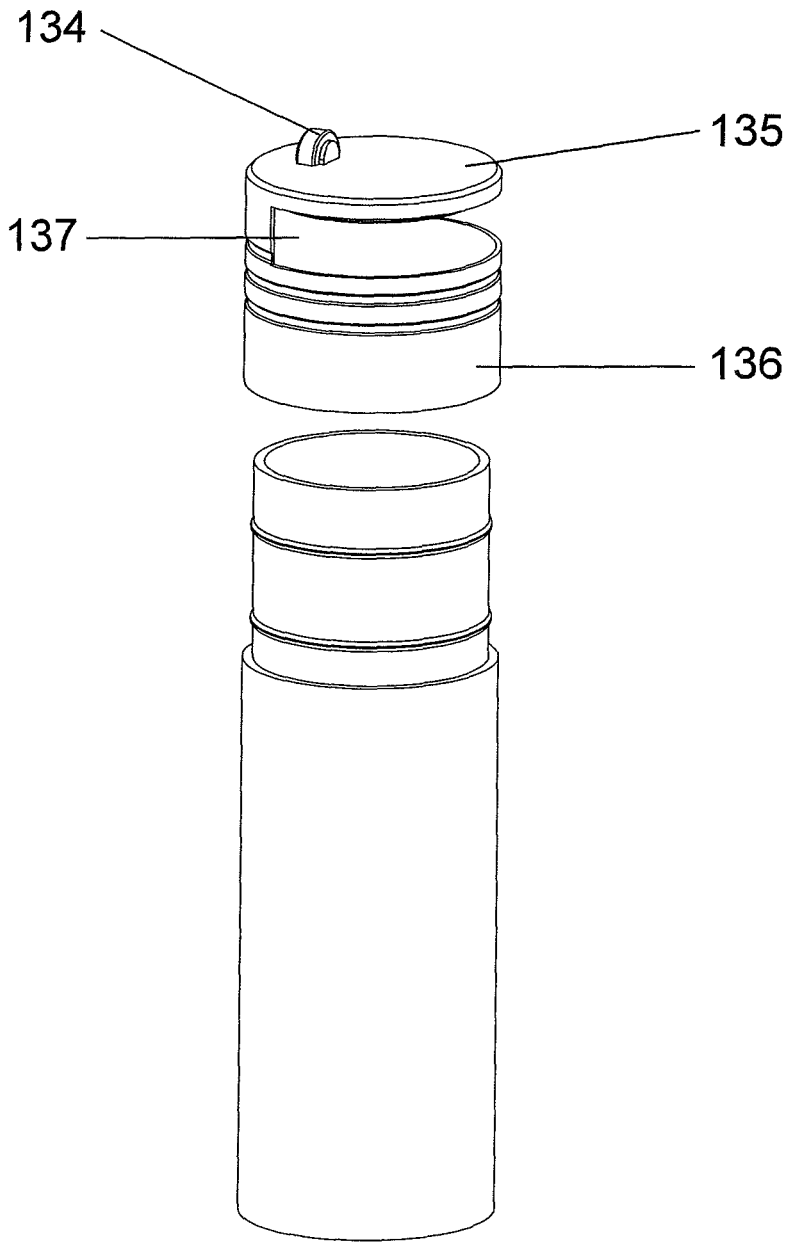

FIG. 27 shows a further embodiment wherein a wheel (134) is mounted on one side of the upper surface (135) of the head (136) adjacent the internal edge of slot (137) so that the applicator may be moved conveniently along the edge of a large sheet, for example on the edge of a desk or other work surface.

The invention claimed is:

1. An adhesive applicator comprising:

(i) an elongate tubular body having a first open end and a second end opposed to the first open end;

(ii) a rod of adhesive material located within the elongated tubular body, said rod being axially moveable along the elongated tubular body so that a free end of the rod is able to travel relatively past the first open end of the elongated tubular body, and for said rod being retainable at a selected axial position; and (iii) an applicator head mounted on the first open end of the elongated tubular body, wherein the head is axially moveable relative to the elongated tubular body and has a mouth configured as a transverse slot for inserting an edge of a sheet material, said mouth having a roof surface for holding the edge of the sheet material between the roof surface and the free end of the rod, and wherein the applicator head has a pressure applicator for receiving pressure to effect movement of the head relatively towards the second end of the elongated tubular body, wherein the applicator head is completely removable from the elongated tubular body, wherein the applicator head is configured to act as a closure for the first open end of the elongated tubular body, and wherein the pressure applicator is provided with a projection extending from the applicator head configured to engage a fixed surface during application of adhesive.

2. An adhesive applicator as claimed in claim 1, wherein the mouth is configured to have rear axially extending edges positioned to permit insertion of the edge of the sheet material such that at least a majority of a full cross-section of the free end of the rod is applied to a marginal edge region of the sheet.

3. An adhesive applicator as claimed in claim 1, wherein the transverse slot is configured to have rear axially extending edges configured to act as guides for linear movement of the edge of the sheet material relatively through the mouth in a direction transverse to an axis of the elongated tubular body.

4. An adhesive applicator as claimed in claim 1, wherein the pressure applicator has a pressure application surface at an end of the applicator head remote from the second end of the elongated tubular body.

5. An adhesive applicator as claimed in claim 4 wherein the pressure applicator is in the form of a disk.

6. An adhesive applicator as claimed in claim 1 wherein said projection is a nipple.

7. An adhesive applicator as claimed in claim 1 wherein said projection comprises a spherical ball mounted for rotation in all directions.

8. An adhesive applicator as claimed in claim 1 wherein the projection comprises a wheel.

9. An adhesive applicator as claimed in claim 1, wherein the applicator head is axially moveable between first and second limit positions, the latter being relatively towards the second end of the elongated tubular body as compared to the former.

10. An adhesive applicator as claimed in claim 9, wherein the applicator head is relatively moveable past the second limit position relatively towards the second end of the elongated tubular body so that the applicator head is able fully to close the elongated tubular body.

11. An adhesive applicator as claimed in claim 9, wherein the applicator head is relatively moveable past the first limit position relatively away from the second end of the elongated tubular body so that the applicator head may be completely removed from the elongated tubular body.

12. An adhesive applicator comprising:

(i) an elongate tubular body having a first open end and a second end opposed to the first open end;

(ii) a rod of adhesive material located within the elongated tubular body, said rod being axially moveable along the elongated tubular body so that a free end of the rod is able to travel relatively past the first open end of the elongated tubular body, and for said rod being retainable at a selected axial position; and (iii) an applicator head mounted on the first open end of the elongated tubular body, wherein the head is axially moveable relative to the elongated tubular body and has a mouth configured as a transverse slot for inserting an edge of a sheet material, said mouth having a roof surface for holding the edge of the sheet material between the roof surface and the free end of the rod, and wherein the applicator head has a pressure applicator for receiving pressure to effect movement of the head relatively towards the second end of the elongated tubular body, wherein the applicator head is completely removable from the elongated tubular body, wherein the applicator head is configured to act as a closure for the first open end of the elongated tubular body, wherein the applicator head has linear movement relative to the elongated tubular body, and wherein said linear movement is constrained to axial movement without rotation.

13. An adhesive applicator as claimed in claim 12, wherein the applicator head has at least one window having axially spaced edges and the elongated tubular body has an internal transverse rib locating in said at least one window.

14. An adhesive applicator as claimed in claim 12, wherein the elongated tubular body has at least one axially parallel linear guide channel and an inner surface of the applicator head has at least one guide projection for location in said at least one axially parallel linear guide channel for guided linear movement of the applicator head.

15. An adhesive applicator as claimed in claim 14, wherein the elongated tubular body is provided with guide edges for guiding said at least one guide projection into said at least one axially parallel linear guide channel.

16. An adhesive applicator as claimed in claim 15, wherein the guide edges incline in a direction going from the first end of the elongated tubular body towards the second end thereof and guide said at least one guide projection to the at least one axially parallel linear guide channel during rotary movement of the applicator head relative to the elongated tubular body.

17. An adhesive applicator as claimed in claim 14, wherein the at least one guide projection on the inner surface of the applicator head is an axially parallel rib.

18. An adhesive applicator as claimed in claim 14, wherein the at least one guide projection is a stud.

19. An adhesive applicator as claimed in claim 1, further comprising an adaptor for clipping onto the elongate tubular body, wherein the adaptor comprises a C-shaped body and a disk-like cap connected to the C-shaped body by a neck, and wherein the C-shaped body and the disk-like cap form a slot opening for receiving a sheet of paper between the C-shaped body and the disk-like cap.

20. An adhesive applicator as claimed in claim 19, wherein the adaptor is slidable relative to the elongate tubular body.

* * * * *